US010273711B2

(12) United States Patent
Song

(10) Patent No.: US 10,273,711 B2
(45) Date of Patent: Apr. 30, 2019

(54) SPRING ASSIST SYSTEM FOR A CANOPY FRAME

(71) Applicant: Ningbo Dongrun Mining Co., Ltd., Zhejiang Province (CN)

(72) Inventor: Li Bo Song, Zhejiang Province (CN)

(73) Assignee: Ningbo Dongrun Mining Co., Ltd., Zhejiang Province (CN)

( * ) Notice: Subject to any disclaimer, the term of this patent is extended or adjusted under 35 U.S.C. 154(b) by 0 days.

(21) Appl. No.: 15/864,692

(22) Filed: Jan. 8, 2018

(65) Prior Publication Data

US 2018/0128006 A1 May 10, 2018

Related U.S. Application Data

(63) Continuation-in-part of application No. 15/598,259, filed on May 17, 2017.

(30) Foreign Application Priority Data

Oct. 17, 2016 (CN) ..... 2016 2 1128983 U

(51) Int. Cl.
*E04H 15/28* (2006.01)
*E04H 15/48* (2006.01)
*E04H 15/50* (2006.01)

(52) U.S. Cl.
CPC ..... *E04H 15/50* (2013.01); *E04H 15/28* (2013.01); *E04H 15/48* (2013.01)

(58) Field of Classification Search
CPC ..... E04H 15/48; E04H 15/28
USPC ..... 135/145, 98
See application file for complete search history.

(56) References Cited

U.S. PATENT DOCUMENTS

| | | | | |
|---|---|---|---|---|
| 5,230,358 | A * | 7/1993 | Forell | E04H 15/40 135/133 |
| 6,581,617 | B2 * | 6/2003 | Ham | E04H 15/28 135/135 |
| 7,350,532 | B2 * | 4/2008 | Wu | E04H 15/48 135/135 |
| 7,607,447 | B1 * | 10/2009 | Han | E04H 15/28 135/135 |
| 7,861,736 | B2 * | 1/2011 | Choi | E04H 15/48 135/135 |
| 8,047,218 | B1 * | 11/2011 | Shin | E04H 15/48 135/135 |
| 8,485,208 | B2 * | 7/2013 | Seo | E04H 15/42 135/135 |
| 9,181,724 | B2 * | 11/2015 | Kim | E04H 15/28 |
| 9,382,723 | B2 * | 7/2016 | Choi | E04H 15/32 |
| 9,784,009 | B2 * | 10/2017 | Choi | E04H 15/48 |
| 2005/0241688 | A1 * | 11/2005 | Wu | E04H 15/48 135/145 |
| 2006/0016467 | A1 * | 1/2006 | Bae | E04H 15/28 135/98 |

(Continued)

*Primary Examiner* — Noah Chandler Hawk
(74) *Attorney, Agent, or Firm* — WPAT, P.C., Intellectual Property Attorneys; Anthony King

(57) ABSTRACT

A spring assist system for a canopy frame. The system including an extension spring, an upper center cap, and a lower center cap. One end of the extension spring is coupled to the upper center cap and the other end is coupled to the lower center cap. A force of the extension spring draws, in an axial direction, the lower center cap toward the upper center cap to decrease a length of the extension spring.

26 Claims, 22 Drawing Sheets

(56) References Cited

U.S. PATENT DOCUMENTS

2006/0289048 A1* 12/2006 Choi ..... E04H 15/48
135/135

* cited by examiner

SPRING ASSIST SYSTEM FOR A CANOPY FRAME

CROSS-REFERENCE TO RELATED APPLICATIONS

This continuation-in-part application claims priority to a Chinese Application No. 201621128983.8 having an application date of Oct. 17, 2016, the U.S. application Ser. No. 15/598,259 filed on May 17, 2017 by the same inventor(s), and pending U.S. application Ser. No. 15/864,649 entitled "Tent Supporting Structure" continuation-in part application filed on Jan. 8, 2018 by the same inventors, and which applications are hereby incorporated by reference in their entirety.

COPYRIGHT NOTICE

This disclosure contains material which is subject to copyright protection. The copyright owner makes no objection to reproduction of this disclosure as disclosed in the Patent and Trademark Office files, record, or the like. Otherwise, the copyright owner reserves all copyright rights whatsoever for this patent disclosure. 37 CFR 1.71(d).

BACKGROUND OF THE DISCLOSURE (1) Field of the Invention

The field of the invention relates to a foldable tent, especially to a clamping and supporting structure of the foldable tent.

(2) Description of Related Art Including Information Disclosed Under 37 CFR 1.97 and 1.98

A tent can provide people traveling, cooking a meal in the open air or working outdoors with a temporary place of keeping out the sun and rain; therefore, it is applied widely. A foldable tent is popular with the users due to excellent practicality.

A conventional foldable tent, such as an umbrella support type foldable tent (application No.: 201210089070.X) in China, includes unfolding rods and bracing rods hinged with the unfolding rods; one end of the unfolding rod is hinged with a top disc; one end of the bracing rod is hinged with a snap-in device; the snap-in device is provided with an expansion rod and comprises a hinging disc; the top disc is provided with a sleeve which is pluggable with the expansion rod; through grooves are arranged on two sides of the hinging disc; clamping blocks are hinged together with the inner parts of the through grooves, and one side of each clamping block is provide with a reset spring; one end of the reset spring is clamped with the clamping block, and the other end thereof is propped against an inner wall of the through groove; one end of the sleeve is provided with a fixture block which is pluggable with the expansion rod; and the clamping block is clamped with the fixture block. However, this snap-in device is complicated in structure and is not useful for production and use; and the snap-in device is not reliable when the spring is applied to clamping.

In order to facilitate operations of one person, a tent support capable of folding quickly (application No.: 201520633723.5) in China has been released, including 2 multiple unfolding rods, bracing rods with each end hinged with the unfolding rod and a quick locking mechanism; an top end of each unfolding rod is hinged with the top disc; an outer tube is arranged on the bottom of the top disc; the quick locking mechanism comprises a tube holder, a handle arranged at the bottom of the tube holder and an inner clamping sleeve which is arranged in the bottom of the outer tube; the top end of the handle is provided with an inner tube bolt passing through the tube holder and capable of stretching into an expansion tube; the part of the inner tube bolt, above the tube holder, is provided with a locking fixture block.

Thus, there is a need for structure for a foldable tent that can be opened conveniently and supported to form a shelter space with large area, or folded into small volume for convenient carrying and storage quickly.

BRIEF SUMMARY OF THE DISCLOSURE

Improved embodiments of a clamping and supporting structure of a tent support are hereby disclosed. The general concept is to provide a reduced user effort opening/closing clamping and tent support structure.

The technical problem to be solved in the utility model is to provide a clamping and supporting structure of a tent support as an illustration to the existing technical problem, advantageously, the clamping and supporting structure can be operated with one hand conveniently.

The following solution is taken to solve the above-mentioned technical problem in the utility model: the clamping and supporting structure of tent support comprises a tube piece, a tube holder, and a handle arranged under the tube holder and the handle arranged under the tube holder. The bottom of the tube piece passes through the tube holder and the handle and can extend oppositely. The clamping and supporting structure includes a locking sleeve which is fixed with the tube holder.

An inner wall of the locking sleeve is provided with a boss including a guiding inclined surface and a top surface. The guide inclined surface is formed on a first side of the boss in the circumferential direction and ascends spirally from the bottom to the top. A stop piece is arranged in the handle.

The tube piece is provided with a first locking pin and a second locking pin and can move opposite to the tube holder and the handle in the vertical direction and keep the trend of rotating oppositely.

During operation, the first locking pin is propped against the guiding inclined surface in the original state and is stopped at the position above the top surface close to a second side of the boss in the circumferential direction in the locking state, and the second locking pin keeps the trend of propping against the stop piece.

Preferably, the tube piece has a rotating trend opposite to the tube holder and the handle by a spring; and the spring is sleeved at the periphery of the tube piece, one end thereof is connected with the tube piece, and the other end thereof is connected with the tube holder.

Preferably, the spring is arranged in this way: an accommodation cavity having an upper opening is formed in the middle of the tube holder; at least one part of the locking sleeve is arranged in the accommodation cavity; the part of the tube piece in the accommodation cavity and the position below the locking sleeve are provided with baffle; and the spring is arranged between the baffle and the bottom wall of the accommodation cavity and are fixed with the baffle and the bottom wall of the accommodation cavity respectively.

Preferably, the spring is connected with the tube piece and the tube holder in this way: an upper lug and a lower lug are formed on an upper end and a lower end of the spring, respectively; a first positioning hole is arranged on the baffle; the bottom of the accommodation cavity is provided with a second positioning hole; the upper lug runs through the first positioning hole, and the lower lug runs through the second positioning hole; and the upper lug twists with certain angle in the circumferential direction opposite to the lower lug.

In order to facilitate positioning of the first locking pin during locking, a second side of the boss is provided with a stop block extending upwards and exceeding the top surface in order to facilitate stopping of the first locking pin in the locking state.

Preferably, the first locking pin runs through the tube piece transversely in order to make the clamping and supporting structure become stable; two bosses are arranged at interval in the circumferential direction, and a gap is formed by the stop block corresponding to one boss and the other boss.

Preferably, the second locking pin runs through the tube piece transversely in order to make the clamping and supporting structure become stable; two stop pieces are arranged in the handle at interval in the circumferential direction;

Preferably, a limiting groove is formed among two stop pieces; and the second locking pin is arranged in the limiting groove after running though an end of the tube piece.

Compared with conventional tent supports, the utility model provide the following locking and spiral inclined surface features as follows: the locking pins are arranged on the tube piece, the locking sleeve is arranged on the tube holder, and the spiral inclined surface is arranged in the locking sleeve to cooperate with the locking pins.

Advantageously, for example, using, the above disclosed features, the tube piece and the tube holder can be locked by operating in the vertical direction only when the tent support is unfolded because the tube piece keeps the rotating trend opposite to the tube holder and can guide the tube piece to extend and ascend opposite to the locking sleeve; and this allows the operations to be implemented with one hand conveniently.

In an aspect of the present embodiment, a snap-in and support structure of a tent support is disclosed. The snap-in and support structure includes: a tube piece, a tube holder, a handle that slides in an axial direction opposite to that of the tube holder, a locking sleeve including a boss integrally formed on an inner circumferential wall. In some embodiments, the boss having a slidably coupled inner surface and a top surface, the slidably coupled inner surface on a first side ascends from a bottom to a top of the inner circumferential wall. In one example, the tube piece is vertically slidable in an axial direction opposite to that of the tube holder and the handle. In one example, a stop piece is included as part of the support structure.

In some embodiments, a first locking pin transversely slides against the slidably coupled inner surface and stops above the top surface and is proximal to a second side of the slidably coupled inner surface in a locking state.

It is contemplated that in some embodiments, the stop piece is arranged about the handle.

It is also contemplated that in some embodiments, the first locking pin traversely extends against the slidably coupled inner surface in an unlocked state along a circumferential direction of the slidably coupled inner surface.

It is also contemplated that in some embodiments, the handle lockably turns to a locked state above the slidably coupled inner surface and upon the handle being slid to a top of the tube holder.

It is also contemplated that in some embodiments, a second locking pin that traversely extends against the stop piece.

It is also contemplated that in some embodiments, a tube holder cavity having an upper portion formed along a midline of the tube holder, at least one portion of the locking sleeve coupled in the tube holder cavity.

It is also contemplated that in some embodiments, a baffle on a portion of the tube piece within the tube holder cavity that is positioned below the locking sleeve.

It is also contemplated that in some embodiments, the baffle is located proximally to a first positioning hole and a bottom of the tube holder cavity is provided with a second positioning hole.

It is also contemplated that in some embodiments, a stopper that extends upwards and beyond the top surface and arranged on the second side of the boss that facilitates locking of the first locking pin in the locking state.

It is also contemplated that in some embodiments, the first locking pin traversely extends through the tube piece; and an additional boss positioned about the boss along the circumferential direction of the locking sleeve.

It is also contemplated that in some embodiments, a gap is formed by the stopper that corresponds to the boss and the additional boss.

It is also contemplated that in some embodiments, the second locking pin traversely couples through the tube piece.

It is also contemplated that in some embodiments, the stop piece and an additional stop piece are arranged spaced-apart along the circumferential direction of the locking sleeve with the handle.

It is also contemplated that in some embodiments, comprising a limiting groove formed among the two stop pieces.

It is also contemplated that in some embodiments, the second locking pin is positioned in the limiting groove after passing through an end of the tube piece.

In an aspect of the present embodiment, a method is disclosed for clamping and supporting a snap-in and support structure of a tent support.

In this method, the steps include: slide a handle in an axial direction opposite to that of a tube holder, vertically slide a tube piece in an axial direction opposite to that of the tube holder, push away the tube piece from the handle and the tube holder along a periphery of the tube piece when the tent support is unfolded, slidably couple the tube piece along a first side of a boss integrally formed on a locking sleeve including an slidably coupled surface on a first side; and ascend a first locking pin from a bottom to a top surface of an inner circumferential wall along the locking sleeve.

It is also contemplated that in some embodiments, method includes the further steps of: traversely extend the first locking pin against the slidably coupled surface in an unlocked state and along a circumferential direction of the locking sleeve; and stop the first locking pin above the top surface proximal to a second side of the slidably coupled surface in a locking state.

It is also contemplated that in some embodiments, the method includes the further steps of: lockably turn the handle to a locked state above the slidably coupled inner surface upon the handle being slid to a top of the tube holder.

It is also contemplated that in some embodiments, the method includes the steps of:

traversely extend a second locking pin against a stop piece about the handle; and slidably couple the tube piece in a tube holder cavity having an upper portion formed along a midline of the tube holder, at least one portion of the locking sleeve coupled in the tube holder cavity.

It is also contemplated that in some embodiments, the method includes the steps of:

slidably couple baffle on a portion of the tube piece within the tube holder cavity that is positioned below the locking sleeve;

lockably rotate the handle to a locked state upon the handle being slid to a top of the tube holder.

It is also contemplated that in some embodiments, the method includes the steps of: extend upwards the tube piece between the baffle located proximally between a first positioning hole, and a bottom of a tube holder cavity is provided with a second positioning hole.

It is also contemplated that in some embodiments, the method includes the steps of: extend a stopper beyond the top surface; and facilitate locking with a stopper on the second side of the slidably coupled surface of the first locking pin in the locking state.

It is also contemplated that in some embodiments, the method includes the steps of: traversely extend the first locking pin through the tube piece and through an additional boss positioned about the boss along the circumferential direction.

It is also contemplated that in some embodiments, the method includes the steps of: traversely extend the first locking pin through a gap formed by the stopper corresponding to the boss and the additional boss; and traversely extend the second locking pin through the tube piece and through the stop piece and an additional stop piece positioned along the circumferential direction.

It is also contemplated that in some embodiments, the method includes the steps of: traversely extend a limiting groove formed among the two stop pieces; and position the second locking pin in the limiting groove after passing through an end of the tube piece.

In yet another aspect of the present embodiment, a spring assist system is disclosed for a canopy. In this system, a frame includes: an extension spring, an upper center cap, and a lower center cap.

One end of the extension spring is coupled to the upper center cap and the other end is coupled to the lower center cap. A force of the extension spring draws, in an axial direction, the lower center cap toward the upper center cap to decrease a length of the extension spring.

It is further contemplated that in some of the embodiments, each of the upper center cap and the lower center cap include at least one connection point used to attach at least one truss structure.

It is further contemplated that in some of the embodiments, at least one of the connection points is radially located on the upper center cap and the lower center cap.

It is further contemplated that in some of the embodiments, the at least one truss structure connected to the lower center cap is pivotally connected, and applies a force onto, the at least one truss structure connected to the upper center cap.

It is further contemplated that in some of the embodiments, a spring sleeve that houses at least a portion of the extension spring, wherein a length of the spring sleeve limits a contraction of the extension spring to a length equivalent to the length of the spring sleeve.

It is further contemplated that in some of the embodiments, a spring sleeve that houses at least a portion of the extension spring, wherein a length of the spring sleeve limits a contraction of the extension spring to a length less than full contraction of the extension spring.

It is further contemplated that in some of the embodiments, the at least one truss structure forms a collapsible canopy framework with pivoting components that limit a contraction of the extension spring to a length less than full contraction of the extension spring.

It is further contemplated that in some of the embodiments, an extension spring tension adjustment mechanism including an adjustable screw having a connectable end attached to an end of the extension spring, the adjustment screw capable of pulling the extension spring so as to adjust a spring tension coefficient of the extension spring.

It is further contemplated that in some of the embodiments, an extension spring tension adjustment mechanism including an adjustable plate having an attachment end attached to an end of the extension spring, the adjustable plate capable of movement back and forth to stretch the extension spring so as to increase a spring tension coefficient of the extension spring.

It is further contemplated that in some of the embodiments, an extension spring tension adjustment mechanism including an adjustable screw at one end of the extension spring and a hook at the other end of the extension spring, the adjustment screw capable of pulling the extension spring so as to adjust a spring tension coefficient of the extension spring.

In another aspect of the same embodiment, a method is disclosed for operating a spring assist system for a canopy frame.

The method includes the steps of: apply a force onto at least one truss structure connected to at least one connection point of a lower center cap to at least one truss structure connected at least one connection point of an upper center cap;

draw in an axial direction the lower center cap toward the upper center cap, and decrease a length of an extension spring coupled between the lower center cap and the upper center cap proportion to the force and a stop limit of axial directional motion of the lower center cap.

It is contemplated in some of the embodiments, the method includes the step of applying a force on the at least one of the connection point of the upper center cap and the lower center cap includes applying a force connection points radially located on the upper center cap and the lower center cap.

It is contemplated in some of the embodiments, the method includes the step of applying a force onto at least one truss structure connected to at least one connection point of a lower center cap to at least one truss structure connected at least one connection point of an upper center cap includes applying a force onto the at least one truss structure connected to at least one connection point of the lower center cap is pivotally connected, and applies a force onto, the at least one truss structure connected to at least one connection point of the upper center cap.

It is contemplated in some of the embodiments, the method includes the step of limiting a contraction of the extension spring to a length equivalent to a length of a spring sleeve that houses at least a portion of the extension spring during axial motion between the upper center cap and the lower center cap.

It is contemplated in some of the embodiments, the method includes the step of limiting a contraction of the extension spring to a length equivalent to length of a spring sleeve that houses at least a portion of the extension spring during axial motion between the upper center cap and the lower center cap. In one example, a length of the spring sleeve limits a contraction of the extension spring to a length less than full contraction of the extension spring.

It is contemplated in some of the embodiments, the method includes the step of pivoting the at least one truss structure of the upper center cap and the lower center cap that forms a collapsible canopy framework with pivoting components that limit a contraction of the extension spring to a length less than full contraction of the extension spring.

It is contemplated in some of the embodiments, the method includes the step of pulling the extension spring using a adjustable screw having a connectable end attached to an end of the extension spring that forms an extension spring tension adjustment mechanism; and It is contemplated in some of the embodiments, the method includes the step of adjusting a spring tension coefficient of the extension spring.

It is contemplated in some of the embodiments, the method includes the steps of moving back and forth an adjustable plate having an attachment end attached to an end of the extension spring that forms an extension spring tension adjustment mechanism, stretching the extension spring, and increasing a spring tension coefficient of the extension spring.

It is contemplated in some of the embodiments, the method includes the steps of moving back and forth an adjustable screw at one end of the extension spring and a hook at the other end of the extension spring that forms an extension spring tension adjustment mechanism, pulling the extension spring with the adjustment screw; and adjusting a spring tension coefficient of the extension spring.

In yet another aspect of the present embodiment, a spring assist system is disclosed for a canopy frame comprising: one or more hinge springs, and one or more truss structures having one or more hinge springs attached to pivot points of the one or more truss structures that form a collapsible canopy framework. Forces of the one or more hinge springs in the pivot points and connections points of the collapsible canopy framework limit unfolding of the collapsible canopy framework.

It is contemplated in some of the embodiments, the system includes an extension spring, an upper center cap, and a lower center cap. One end of the extension spring is coupled to the upper center cap and the other end is coupled to the lower center cap. A force of the extension spring draws, in an axial direction, the lower center cap toward the upper center cap to decrease a length of the extension spring.

It is contemplated in some of the embodiments, the system includes each of the upper center cap and the lower center cap include at least one connection point used to attach at least one truss structure.

It is contemplated in some of the embodiments, the system includes at least one of the connection points is radially located on the upper center cap and the lower center cap.

It is contemplated in some of the embodiments, the system includes at least one truss structure connected to the lower center cap is pivotally connected, and applies a force onto, the at least one truss structure connected to the upper center cap.

It is contemplated in some of the embodiments, the system includes at least one truss structure forms the collapsible canopy framework with pivoting components that limit a contraction of the extension spring to a length less than full contraction of the extension spring.

It is contemplated in some of the embodiments; the system includes an extension spring tension adjustment mechanism including an adjustable screw having a connectable end attached to an end of the extension spring, the adjustment screw capable of pulling the extension spring so as to adjust a spring tension coefficient of the extension spring.

It is contemplated in some of the embodiments, the system includes an extension spring tension adjustment mechanism including an adjustable plate having an attachment end attached to an end of the extension spring, the adjustable plate capable of movement back and forth to stretch the extension spring so as to increase a spring tension coefficient of the extension spring.

It is contemplated in some of the embodiments; the system includes an extension spring tension adjustment mechanism including an adjustable screw at one end of the extension spring and a hook at the other end of the extension spring, the adjustment screw capable of pulling the extension spring so as to adjust a spring tension coefficient of the extension spring.

It is contemplated in some of the embodiments; the system includes a spring sleeve that houses at least a portion of the extension spring, wherein a length of the spring sleeve limits a contraction of the extension spring to a length equivalent to the length of the spring sleeve.

It is contemplated in some of the embodiments; the system includes a spring sleeve that houses at least a portion of the extension spring, wherein a length of the spring sleeve limits a contraction of the extension spring to a length less than full contraction of the extension spring.

Various objects, features, aspects and advantages of the present invention will become More apparent from the following detailed description of preferred embodiments of the invention, along with the accompanying drawings in which like numerals represent like components.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The invention may seek to satisfy one or more of the above-mentioned desires. Although the present invention may obviate one or more of the above-mentioned desires, it should be understood that some aspects of the invention might not necessarily obviate them.

BRIEF DESCRIPTION OF THE DRAWINGS

It should be noted that the drawing figures may be in simplified form and might not be to precise scale. In reference to the disclosure herein, for purposes of convenience and clarity only, directional terms, such as, top, bottom, left, right, up, down, over, above, below, beneath, rear, front, distal, and proximal are used with respect to the accompanying drawings. Such directional terms should not be construed to limit the scope of the invention in any manner.

DETAILED DESCRIPTION OF THE DISCLOSURE

The disclosure and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the disclosure. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

The following shall further explain the utility model in detail by combining with the figures and embodiments.

Figure 1:
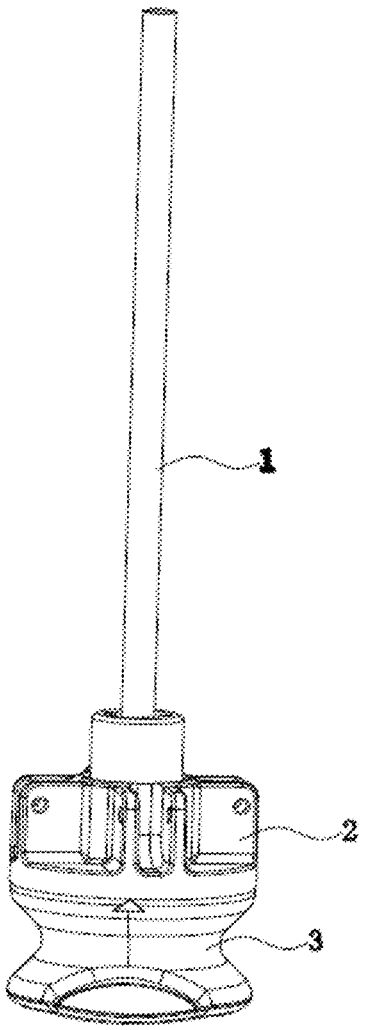
FIG. 1 is a front view of a snap-in and support structure of the utility model in accordance with an embodiment of the present disclosure.
Figure 2:
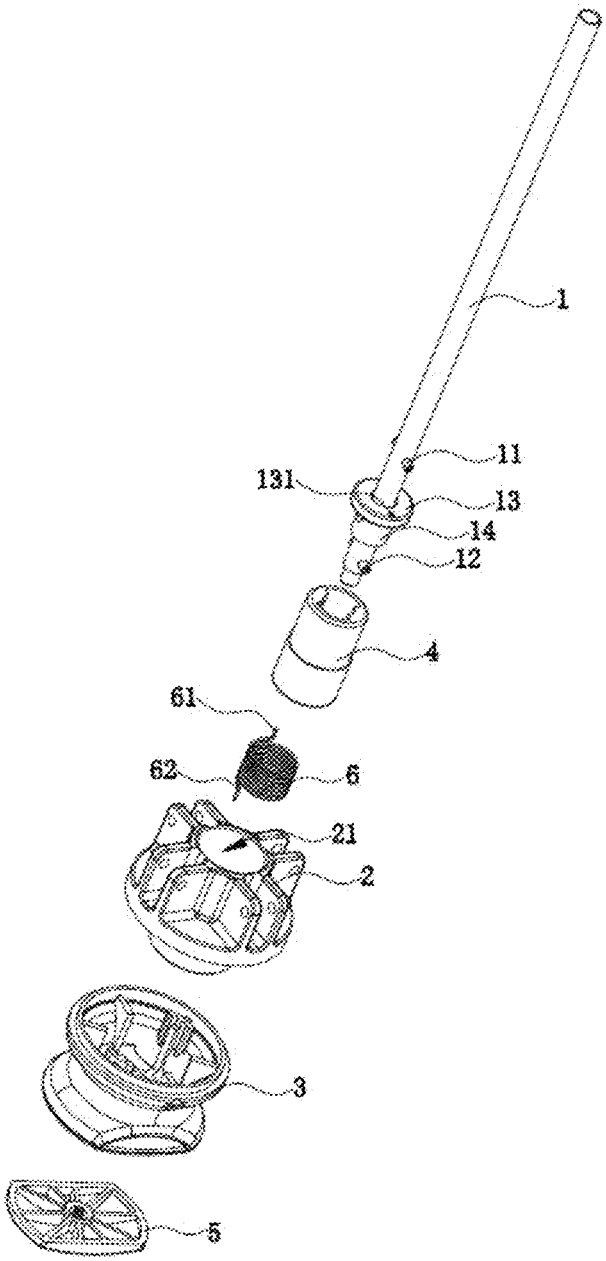
FIG. 2 is a front perspective view of partially exploded view of the snap-in and support structure of the utility model of FIG. 1 in accordance with an embodiment of the present disclosure.
Figure 3:
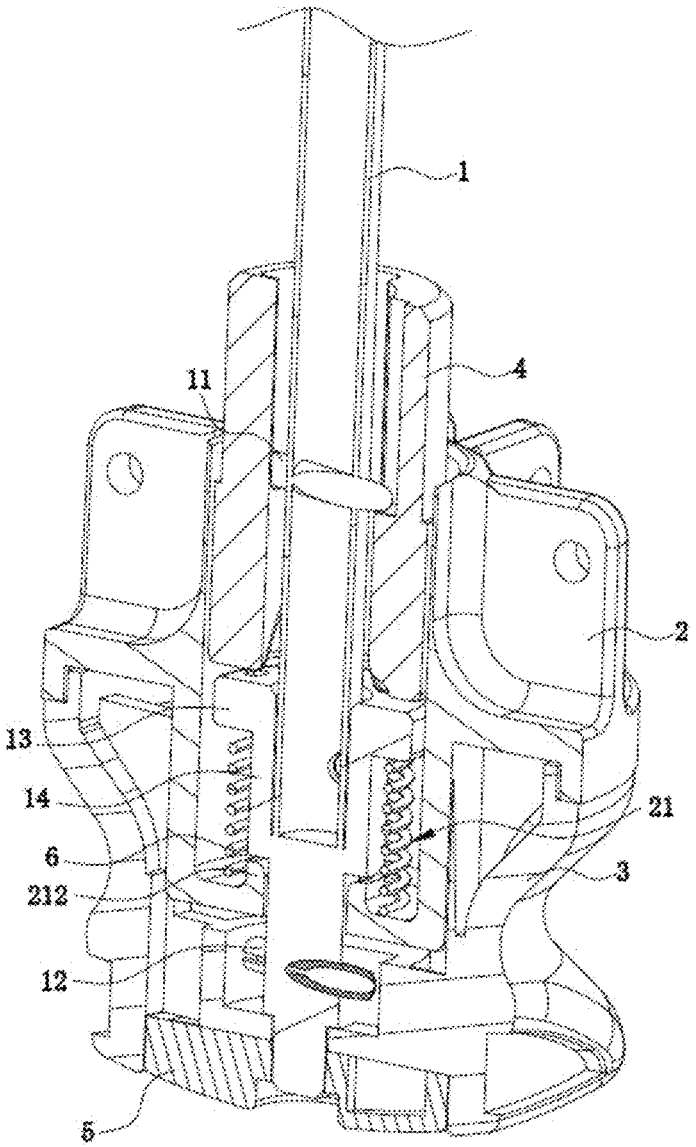
FIG. 3 is a front cross-sectional view of the snap-in and support structure of the utility model of FIG. 1 in accordance with an embodiment of the present disclosure.

As shown in FIGS. 1-3, a snap-in and support structure of tent support comprises a tube piece 1, a tube holder 2, a handle 3 and a locking sleeve 4; see a telescopic tube and a tube holder in the patent (application No.: 201520633723.5) in China listed in the background technology for the functions of the tube piece 1 and the tube holder 2 in the tent support, and the effects thereof shall not be repeated.

Through hole extending longitudinally is arranged in the middle of the tube holder, thereby forming an accommodation cavity 21 having an upper opening. In some embodiments, at least one part of the locking sleeve 4 is arranged in the accommodation cavity 21. The handle 3 is arranged under the tube holder 2 and is presented as a hollow handle with the upper opening. The accommodation cavity 21 of the tube holder 2 is arranged in the handle 3 partially.

The bottom of the tube piece 1 is provided with a first locking pin 11, a second locking pin 12, a baffle 13 and a limiting sleeve 14. In one example, the first locking pin 11 and the second locking pin 12 pass through the tube piece 1 respectively and transversely and are arranged at interval from the top to the bottom. In some embodiments, the first locking pin 11 is arranged above the second locking pin 12. In some embodiments, the baffle 13 is sleeved at the periphery of the tube piece 1 and arranged between the first locking pin 11 and the second locking pin 12. In some embodiments, the limiting sleeve 14 is sleeved at the periphery of the tube piece 1 and arranged under the baffle 13.

In one example, a limiting boss 212 extends upwards and is arranged in the middle of a bottom wall of the accommodation cavity 21 and the bottom of the limiting sleeve 14 is arranged on the limiting boss 212. Moreover, the baffle 13, the limiting sleeve 14 and the tube piece 1 can also be formed integrally. In one example, the diameters of the baffle 13 and the limiting sleeve 14 are greater than that of the tube piece 1.

The bottom of the tube piece 1 passes through the locking sleeve 4 and extends into the handle 3 after passing through the bottom of the accommodation cavity 21 of the tube holder 2; and the bottom of the tube piece 1 extends to the place under the handle 3 along the decreasing diameter. Moreover, an end cover 5 is arranged under the handle 3 and is connected with the bottom of the tube piece 1 through the screw.

Advantageously, the first locking pin 11 is arranged in the locking sleeve 4 to cooperate with each other. In some embodiments, the second locking pin 12 is positioned in the handle 3 under the tube holder 2 and while the baffle 13 is positioned under the locking sleeve 4. Moreover, the tube piece 1 moves opposite to the tube holder 2 with certain range in the vertical direction.

A spring 6 is arranged at the periphery of the tube piece 1 and between the baffle and the bottom wall of the accommodation cavity 21. In some embodiments, an upper lug 61 of an upper boss and a lower lug 62 of a lower boss are formed on an upper end and a lower end of the spring 6, respectively. In some embodiments, the baffle 13 is provided with a first positioning hole 131, and the bottom wall of the accommodation cavity 21 is provided with a second positioning hole 211.

Figure 5:
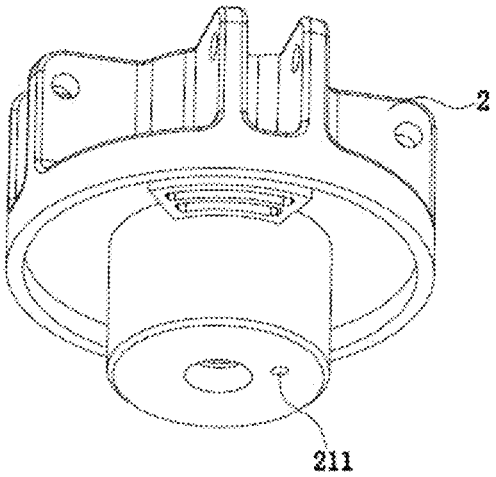
FIG. 5 is a bottom perspective view of a tube holder of the snap-in and support structure of the utility model of FIG. 1 in accordance with an embodiment of the present disclosure.

As shown in FIG. 5, advantageously the first positioning hole 131 twists with certain angle in the circumferential direction opposite to the second positioning hole 211. As such, the first positioning hole 131 and the second positioning hole 211 are positioned on the different vertical line. Moreover, the upper lug 61 passes through the first positioning hole 131 and the lower lug 62 passes through the second positioning hole 211; thus, the spring 6 is positioned.

Figure 4:
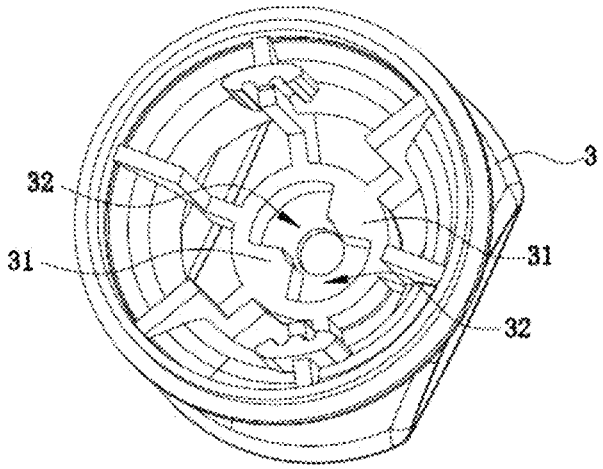
FIG. 4 is a top perspective view of a handle of the snap-in and support structure of the utility model of FIG. 1 in accordance with an embodiment of the present disclosure.

As shown in FIGS. 3 and 4, two stop pieces 31 which are arranged in the circumferential direction at interval are formed at the bottom of the handle 3, preferably two stop pieces 31 are arranged symmetrically with respect to the center, and a limiting groove 32 is formed among the two stop pieces 31.

Advantageously, the second locking pin 12 runs through two ends of the tube piece 1 and are positioned in the limiting groove 32 among two stop pieces 31, respectively; the second locking pin 12 keeps the trend of propping against corresponding stop piece 31 in presence of the spring 6.

Figure 6:
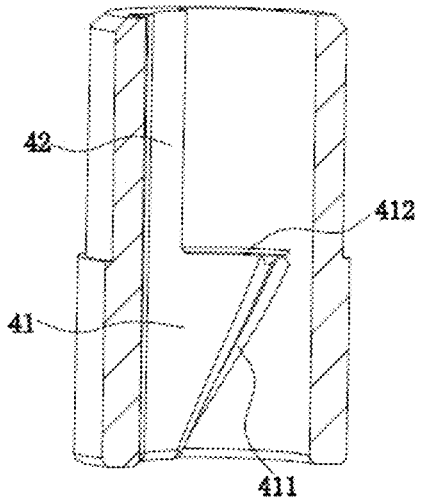
FIG. 6 is the longitudinal sectional view of a locking sleeve of the snap-in and support structure of the utility model of FIG. 1 in accordance with an embodiment of the present disclosure.
Figure 7:
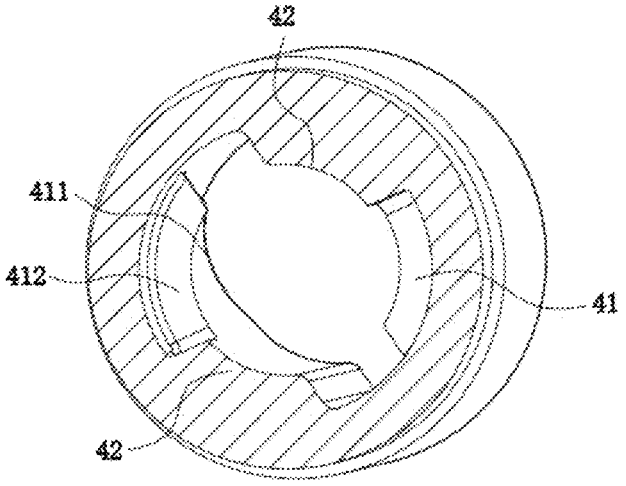
FIG. 7 is the transverse sectional view of the locking sleeve of the snap-in and support structure of the utility model of FIG. 1 in accordance with an embodiment of the present disclosure.

As shown in FIGS. 6 and 7, a lower part of the locking sleeve 4 is provided with bosses 41 which are arranged in the circumferential direction at interval, and the bosses are formed on an inner wall of the locking sleeve 4 after extending inward in the radial direction. The boss 41 comprises a guide inclined surface 411 ascending spirally from the bottom to the top in the circumferential direction and formed on a first side and a top surface 412. For example, a guide inclined surface 411 is a slidably coupled inclined surface 411.

In some embodiments, a second side of the boss 41 in the circumferential direction far from the guide inclined surface 411 is provided with a stopper 42. For example, the stopper 42 is formed on the inner wall of the locking sleeve 4 after extending inward in the radial direction, and extends upwards from the bottom of the locking sleeve 4.

Advantageously, the smooth transition occurs between the first side of the stopper 42 and the stop surface 412 of the boss 41, and the second side of the stopper 42 is opposite to the guide inclined surface 411 of the other boss 41.

During installation, the following steps occur:

1) sleeve the spring on the tube piece 1, twist for certain degree to make it have certain pre-tightening force; then fix the two lugs of the spring 6 with the tube piece 1 and the tube holder 2 respectively; and 2) insert the tube piece 1 into the locking sleeve 4, the tube holder 2 and the handle 3, and connect with the tube piece 1 after covering an end cover 5 at the bottom of the handle 3.

Advantageously to facilitate opening, closing, and locking of the tent structure, two ends of the first locking pin 11 on the tube piece 1 are propped against the guide inclined surface 411 of the boss 41 in the locking sleeve 4 respectively, and two ends of the second locking pin 12 on the tube piece 1 are propped against the side of the stop piece 31 in the handle respectively at this time.

In some embodiments, the spring 6 shall be further compressed by pushing the handle 3 upward when the tent is unfolded. More specifically, twist the tube piece 1 opposite to the tube holder 2 and twist the spring 6 at the same time. Advantageously, the second locking pin 12 gradually moves away from the stop piece 31 propped against it originally, and the first locking pin 12 on the tube piece 1 moves upwards along the guide inclined surface 411 of the boss 41 until it achieves the top surface 412 of the boss 41.

Following, the first locking pin 11 rotates toward the direction of the stopper 42 along the top surface 412 until it is propped against the stopper 42 in presence of the resetting force of the spring 6, and the second locking pin 12 is propped against the stop piece 31 which is identical in the original state.

Advantageously, the tent support can be unfolded stably because the tube piece 1, the tube holder 2 and the handle 3 are locked rather than rotate oppositely. Moreover, the tent can be unfolded with one hand by pushing the handle 3 upward only during unfolding the above-mentioned tent.

On the other hand, when the tent is required to fold, rotate the handle 3 reversely to make the first locking pin 11 of the tube piece 11 move toward the direction far away from the stop piece 42 until it is removed out from the top surface 412 of the boss 41.

More specifically, the first locking pin 11 can move downward directly along the gap between the boss 41 and the other stopper 42 by pulling the handle 3 downward. Advantageously, during this process, the spring 6 is twisted and the second locking pin 12 gradually moves away from the stop piece 31 which is propped against the second locking pin 12 originally.

After achieving the position downward, the first locking pin 11 rotates toward the direction of the guide inclined surface 411 of the boss 41 again in presence of the resetting force of the spring 6 until the first locking pin 11 is propped against the guide inclined surface 411, and the second locking pin 12 is propped against the stop piece 31 which is identical in the original state. Thus, the tent is folded at this moment.

In summary, as illustrated most notably in its FIGS. 1-7, a snap-in and support structure of a tent support is disclosed including a tube piece 1; a tube holder 2; a handle 3 oppositionally extendably, i.e., slides in an axial direction opposite, to the tube holder 2; and a locking sleeve 4 including on an inner circumferential wall a boss 41 having a slidably coupled inclined surface 411 and a top surface 412.

In some embodiments, the slidably coupled inclined surface 411 on a first side of the boss 41, i.e., that is integrally formed in the slidably coupled inclined surface 411, ascends spirally from a bottom to a top of the inner circumferential wall and wherein the tube piece 1 is oppositionally, vertically, slidable, i.e., slides in an axial direction opposite, from the tube holder 2 and the handle 3. In some embodiments, a stop piece 31 is arranged about the handle 3 and/or a first locking pin 11 that traversely extends against the slidably coupled inclined surface 411 in an original state, i.e., an unlocked state, and along a circumferential direction of the slideably coupled inclined surface 411. In some embodiments, the first locking pin 11 is stopped above the top surface 412 proximal to a second side of the slidably coupled inclined surface 411 in a locking state and/or a second locking pin 12 traversely extended against the stop piece 31. In some embodiments, a spring 6 is coupled within a sleeve and along a periphery of the tube piece 1 and one end of the spring 6 coupled to the tube piece 1 and another end to the tube holder 2.

In some embodiments, a tube holder cavity 21 includes an upper portion formed along a midline of the tube holder 2, at least one portion of the locking sleeve 4 coupled in the tube holder cavity 21 and/or baffle 13 on a portion of the tube piece 1 within the tube holder cavity 21 that are positioned below the locking sleeve 4. In one example, the spring 6 is coupled between the baffle 13 and a bottom wall of the tube holder cavity 21 and fixed within the baffle 13 and a bottom wall of a tube holder cavity 21 respectively.

In some embodiments, an upper lug 61 and a lower lug 62 respectively located on an upper and a lower end of the spring 6. In some embodiments, the upper lug 61 couples through the first positioning hole 131, and the lower lug 61 couples through the second positioning hole 211; and the upper lug 61 twists for a specified angular direction in the circumferential direction oppositionally to that of the lower lug 62.

In some embodiments, the baffle 13 is located proximally to a first positioning hole 131, and a bottom of the tube holder cavity 21 is provided with a second positioning hole 211 and/or a stopper 42 extended upwards and beyond the top surface 412 and arranged on the second side of the boss 41 that facilitates locking of the first locking pin 11 in the locking state.

In some embodiments, the first locking pin 11 traversely extends through the tube piece 1; and an additional boss 41 positioned about the boss 41 along the circumferential direction of the locking sleeve.

In some embodiments, a gap is formed by the stopper 42 that corresponds to the boss 41 and the additional boss 41 and/or the second locking pin 12 traversely couples through the tube piece 1. In some embodiments, the stop piece 31 and an additional stop piece 31 are arranged spaced-apart along the circumferential direction of the locking sleeve 4. In some embodiments, a limiting groove 32 is formed among the two stop pieces 31. In some embodiments, the second locking pin 12 is positioned in the limiting groove 32 after passing through an end of the tube piece 1.

Figure 8:
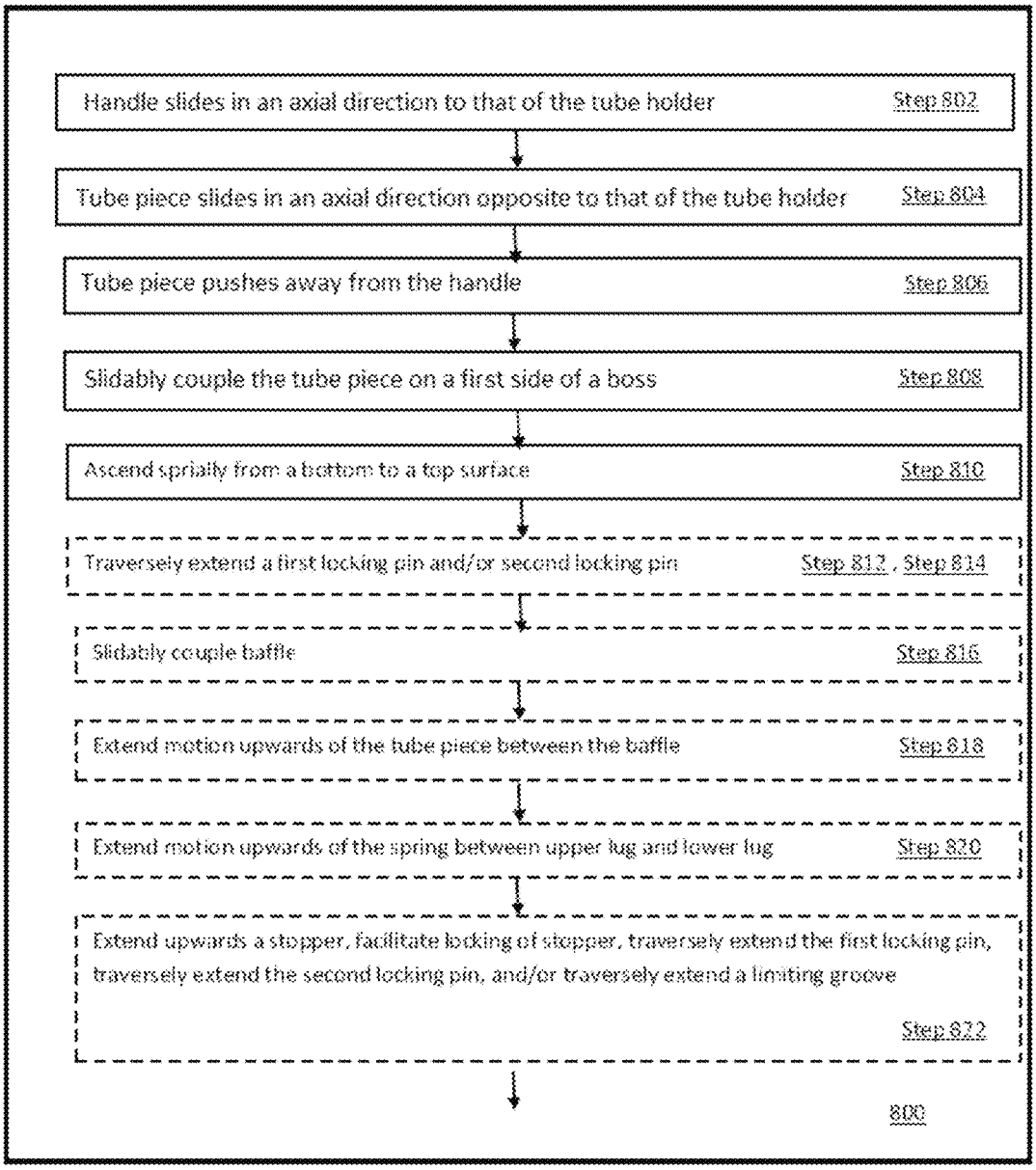
FIG. 8 is method for clamping and supporting a snap-in and support structure of a tent support of FIG. 1 in accordance with an embodiment of the present disclosure.

As illustrated in FIG. 8, a method 800 is disclosed for clamping and supporting a snap-in and support structure of a tent support.

In step 802, a handle 3 slides in an axial direction to that of a tube holder 2.

In step 804, a tube piece 1 slides in an axial direction opposite to that of the tube holder 2.

In step 806, the tube piece 1 pushes away from the handle 3, and the tube holder 2 using a spring 6 coupled within a sleeve along a periphery of the tube piece 1, one end of the spring 6 is coupled to the tube piece 1 and another end to the tube holder 2;

In step 808, slidably couple the tube piece on a first side of a boss 41 integrally formed on a locking sleeve 4 including an slidably coupled inclined surface 411 on a first side.

In step 810, ascend spirally a first locking pin from a bottom to a top surface 412 of an inner circumferential wall on a locking sleeve 4.

In step 812, traversely extends a first locking pin 11 against the slidably coupled inclined surface 411 in an original state, i.e., unlocked state, along a circumferential direction. In one additional embodiment, the step 612 further includes stop the first locking pin 11 above the top surface 412 proximal to a second side of the slidably coupled inclined surface 411 in a locking state.

In step 814, traversely extends a second locking pin 12 against a stop piece 31 about the handle 3. In additional embodiment, step 814 further includes slidably couple the tube piece 1 in a tube holder cavity 21 having an upper portion formed along a midline of the tube holder 2, at least one portion of the locking sleeve 4 coupled in the tube holder cavity 21.

In step 816, slidably couple baffle 13 on a portion of the tube piece 1 within the tube holder cavity 21 that is positioned below the locking sleeve 4. In an additional embodiment, step 816 further includes slidably couple the spring 6 between the baffle 13 and a bottom wall of the tube holder cavity 21 and fixed within the baffle 13 and a bottom wall of the tube holder cavity 21 respectively. In an additional embodiment, step 816 further includes extends motion of the spring 6 between an upper lug 61 and a lower lug 62 respectively located on an upper and a lower end of the spring 6.

In step 818, extends motion upwards of the tube piece 1 between the baffle 13 located proximally between a first positioning hole 131, and a bottom of the tube holder cavity 21 is provided with a second positioning hole 211.

In step 820, extends upwards of the spring 6 between the upper lug 61 that couples through the first positioning hole 131, and the lower lug 61 that couples through the second positioning hole 211. In one additional embodiment, step 820 includes twist the upper lug 61 for a specified angular direction in the circumferential direction oppositionally, i.e., slides or extends in an axial direction opposite to that of the lower lug 62.

In step 822, extends upwards a stopper 42 beyond the top surface 412. In one additional step of 822, facilitate locking with the stopper 42 on the second side of the slidably coupled inclined surface 411 of the first locking pin 11 in the locking state.

In one additional embodiment of step 822, traversely extends the first locking pin 11 through the tube piece 1 and though an additional boss 41 positioned about the boss 41 along the circumferential direction. In one additional embodiment of step 822, traversely extends the first locking pin 11 through a gap formed by the stopper 42 corresponding to the boss 41 and the additional boss 41.

In yet another additional embodiment of step 822, traversely extends the second locking pin 12 through the tube piece 1 and through the stop piece 31 and arrange an additional stop piece 31 positioned along the circumferential direction. In yet another additional embodiment of step 822, traversely extends a limiting groove 32 formed among the two stop pieces 31; and position the second locking pin 12 in the limiting groove 32 after passing through an end of the tube piece 1.

It should be noted that step(s) 812-822 is/are optional steps and may not be implemented in all cases. Optional steps of method 800 are illustrated using dotted lines in FIG. 8 so as to distinguish them from the other steps of method 800.

Figure 9:
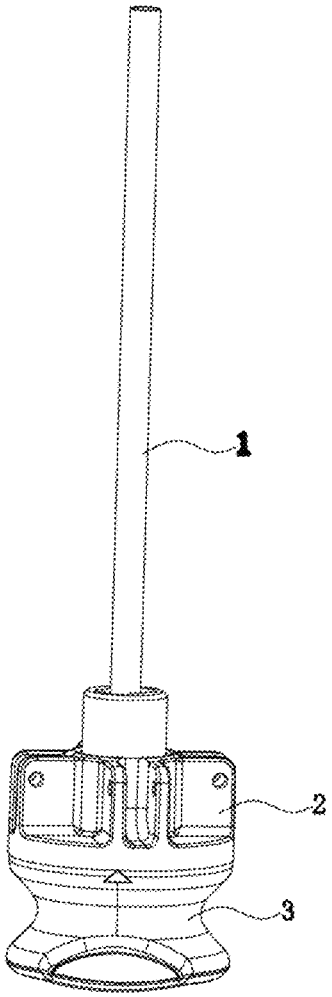
FIG. 9 is a front view of a snap-in and support structure of the utility model of an alternative embodiment of FIG. 1 in accordance with an embodiment of the present disclosure.
Figure 10:
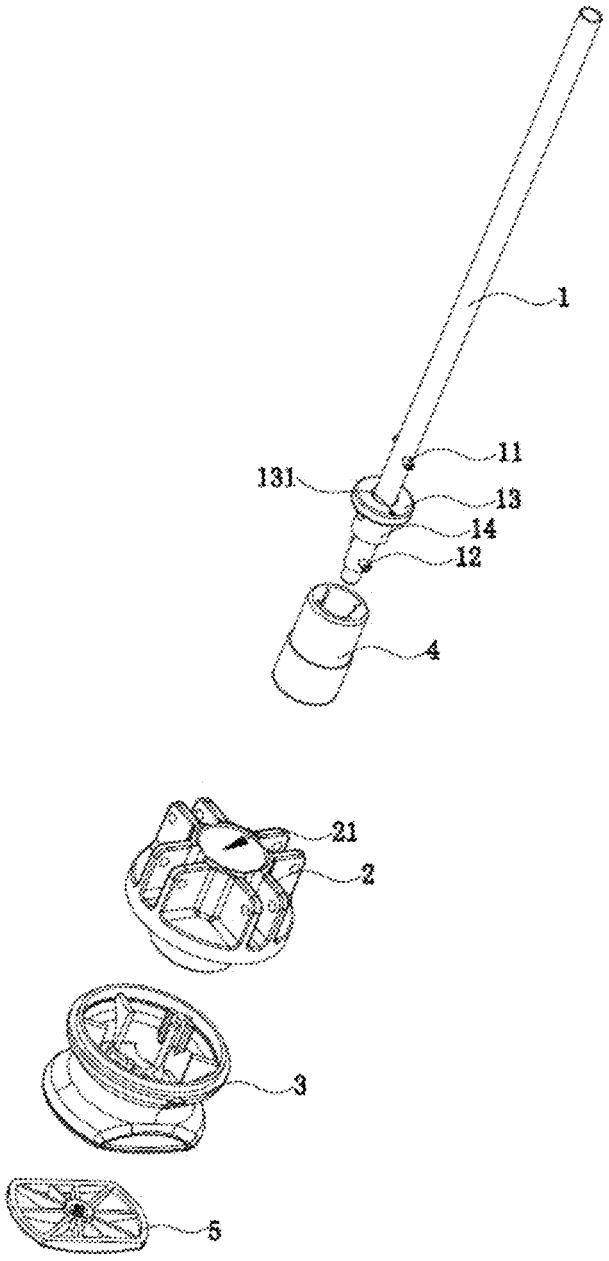
FIG. 10 is a front perspective view of partially exploded view of the snap-in and support structure of the utility model of FIG. 9 in accordance with an embodiment of the present disclosure.
Figure 11:
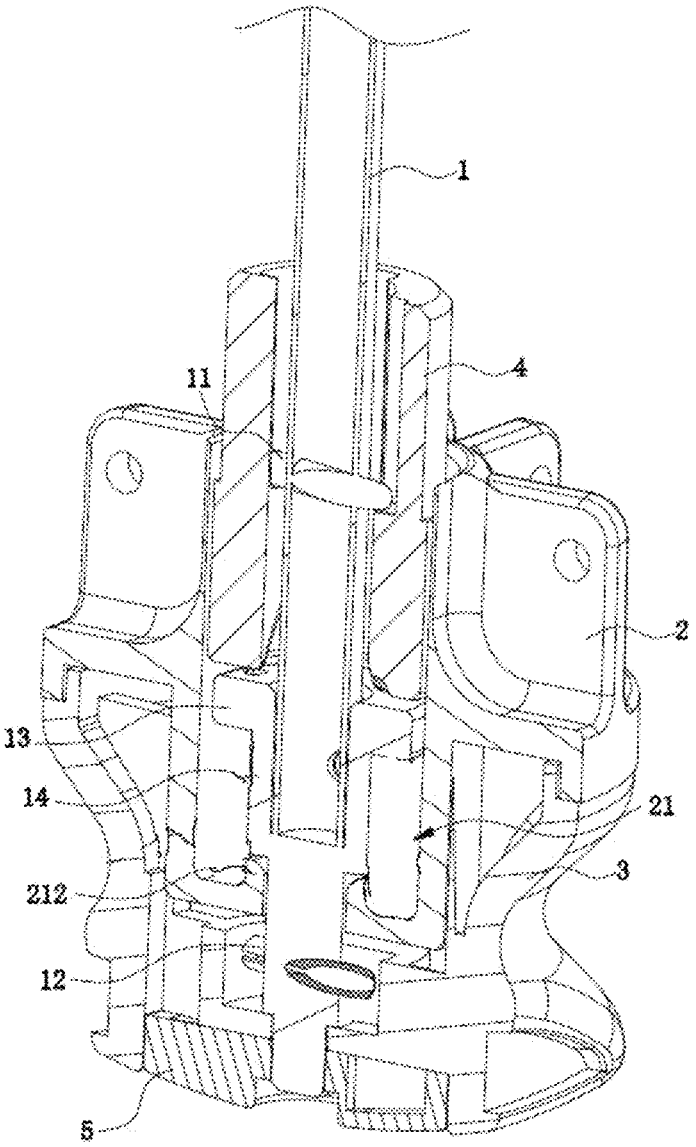
FIG. 11 is a front cross-sectional view of the snap-in and support structure of the utility model of FIG. 9 in accordance with an embodiment of the present disclosure.
Figure 12:
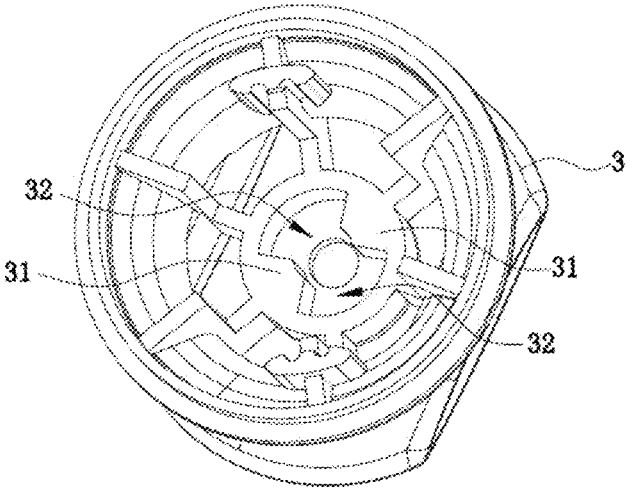
FIG. 12 is a top perspective view of a handle of the snap-in and support structure of the utility model of FIG. 9 in accordance with an embodiment of the present disclosure.
Figure 13:
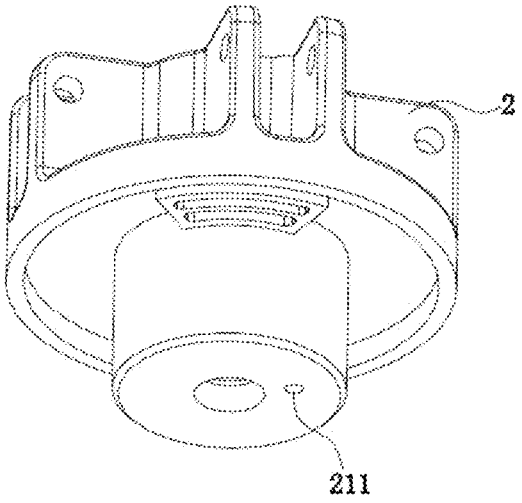
FIG. 13 is a bottom perspective view of a tube holder of the snap-in and support structure of the utility model of FIG. 9 in accordance with an embodiment of the present disclosure.
Figure 14:
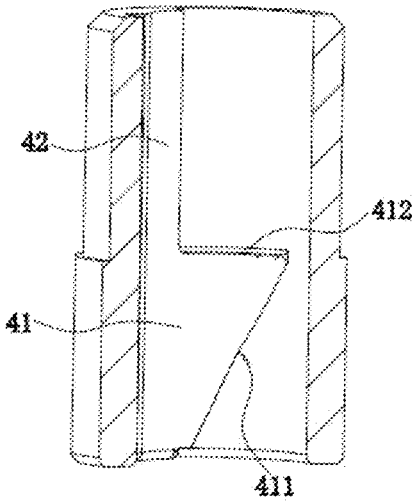
FIG. 14 is the longitudinal sectional view of a locking sleeve of the snap-in and support structure of the utility model of FIG. 9 in accordance with an embodiment of the present disclosure.
Figure 15:
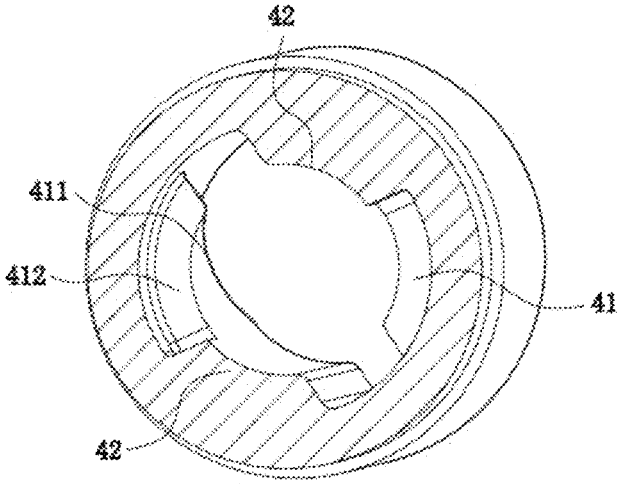
FIG. 15 is the transverse sectional view of the locking sleeve of the snap-in and support structure of the utility model of FIG. 9 in accordance with an embodiment of the present disclosure.

Referring now to FIG. 9, a front view of a snap-in and support structure of the utility model is disclosed of an alternative embodiment of FIG. 1 in accordance with an embodiment of the present disclosure. Furthermore, FIGS. 10-15 are several embodiments that include examples of each of its features disclosed as an alternative embodiment of FIG. 1 and illustrative of FIG. 9 in accordance with an embodiment of the present disclosure.

In one aspect of a present embodiment, a snap-in and support structure of a tent support is disclosed including a tube piece 1, a tube holder 2, a handle 3, and a locking sleeve 4. A handle 3 slides in an axial direction opposite to that of the tube holder 2. In some embodiments, a locking sleeve 4 is disclosed including a boss 41 integrally formed on an inner circumferential wall. In an example, the boss 41 has a slidably coupled inner surface and a top surface 412. In an example, the slidably coupled inner surface on a first side ascends from a bottom to a top of the inner circumferential wall.

In some embodiments, the tube piece 1 is vertically slidable in an axial direction opposite to that of the tube holder 2 and the handle 3. In an example, the tent support includes a stop piece 31. In some embodiments, a first locking pin 11 transversely slides against the slidably coupled inner surface and stops above the top surface 412 and is proximal to a second side of the slidably coupled inner surface in a locking state. In an example, the stop piece 31 is arranged about the handle 3. In some embodiments, the first locking pin 11 traversely extends against the slidably coupled inner surface in an unlocked state-along a circumferential direction of the slidably coupled inner surface. In some embodiments, the handle 3 lockably turns to a locked state above the slidably coupled inner surface and upon the handle 3 being slid to a top of the tube holder 2.

In some embodiments, a second locking pin 12 traversely extends against the stop piece 31. In an example, a tube holder cavity 21 includes an upper portion formed along a midline of the tube holder 2, and at least one portion of the locking sleeve 4 coupled in the tube holder cavity 21. In some embodiments, a baffle 13 is disclosed on a portion of the tube piece 1 within the tube holder cavity 21 that is positioned below the locking sleeve 4. In an example, the baffle 13 is located proximally to a first positioning hole 131 and a bottom of the tube holder cavity 21 is provided with a second positioning hole 211.

In some embodiments, a stopper 42 extends upwards and beyond the top surface 412 and arranged on the second side of the boss 41 that facilitates locking of the first locking pin 11 in the locking state. In one or more instances, the first locking pin 11 traversely extends through the tube piece 1. In one or more examples, an additional boss 41 is positioned about the boss 41 along the circumferential direction of the locking sleeve 4. In some embodiments, a gap is formed by the stopper 42 that corresponds to the boss 41 and the additional boss 41.

In some embodiments, a second locking pin 12 traversely couples through the tube piece 1. In one or more instances, the stop piece 31 and an additional stop piece 31 are arranged spaced-apart along the circumferential direction of the locking sleeve 4 with the handle 3. In one or more examples, a limiting groove 32 is formed among the two stop pieces 31. In one or more instances, the second locking pin 12 is positioned in the limiting groove 32 after passing through an end of the tube piece 1.

Figure 16:
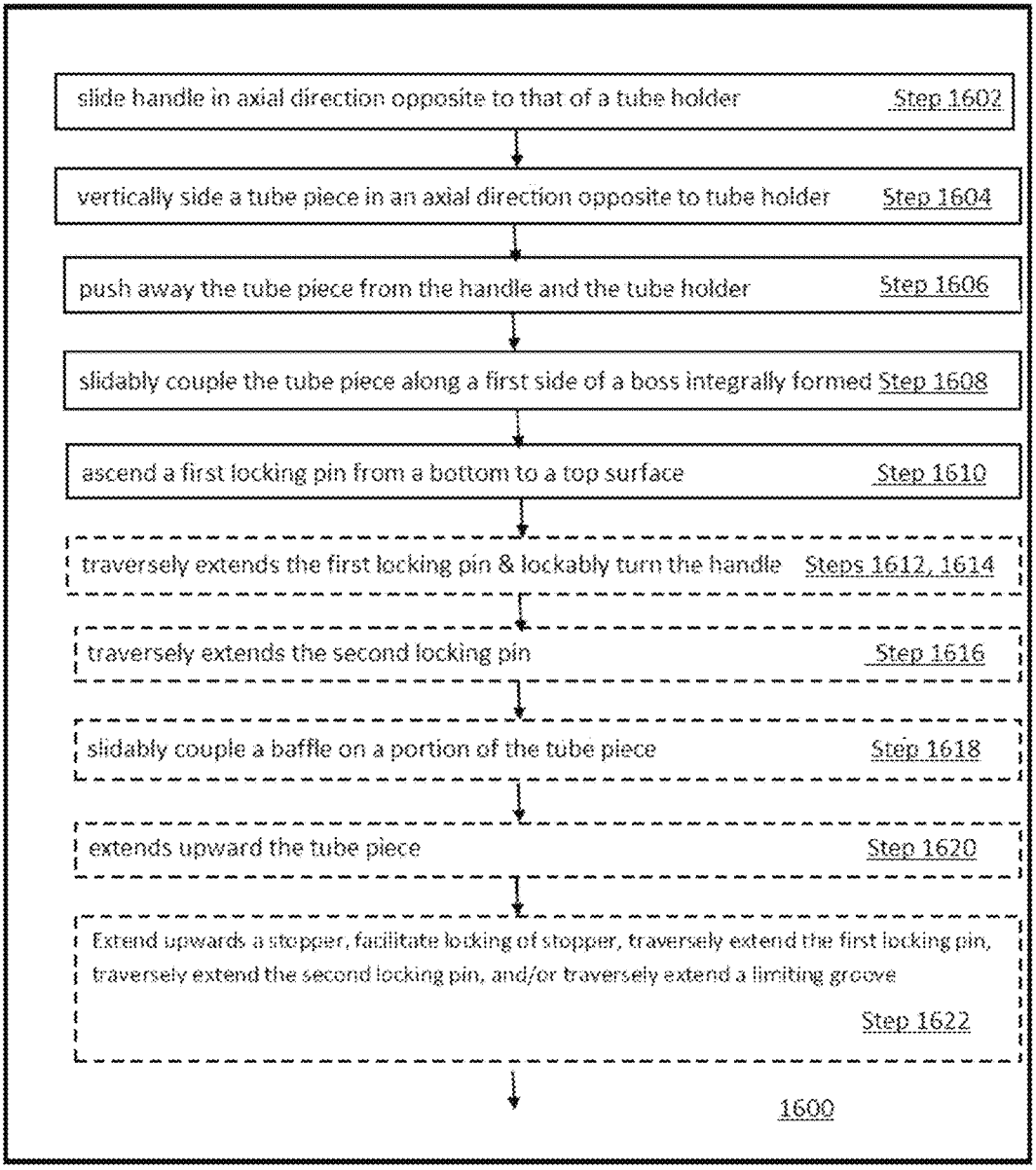
FIG. 16 is method for clamping and supporting a snap-in and support structure of a tent support of FIG. 9 in accordance with an embodiment of the present disclosure.

Referring to FIG. 16, a method is disclosed for clamping and supporting a snap-in and support structure of a tent support of FIG. 9 in accordance with an embodiment of the present disclosure.

As illustrated in method 1600, a process is disclosed for unfolding a clamping and supporting a snap-in and support structure of a tent support including the following steps:

in step 1602, slide a handle 3 in an axial direction opposite to that of a tube holder 2;

in step 1604, vertically slide a tube piece 1 in an axial direction opposite to that of the tube holder 2;

in step 1606, push away the tube piece 1 from the handle 3 and the tube holder 2 along a periphery of the tube piece 1 when the tent support is unfolded;

in step 1608, slidably couple the tube piece 1 along a first side of a boss 41 integrally formed on a locking sleeve 4 including an slidably coupled surface on a first side; and in step 1610, ascend a first locking pin 11 from a bottom to a top surface 412 of an inner circumferential wall along the locking sleeve 4.

In step 1612, the method 1600 includes the step of: traversely extends the first locking pin 11 against the slidably coupled surface in an unlocked state and along a circumferential direction of the locking sleeve 4, and stop the first locking pin 11 above the top surface 412 proximal to a second side of the slidably coupled surface in a locking state.

In step 1614, the method 1600 includes: lockably turn the handle 3 to a locked state above the slidably coupled inner surface upon the handle 3 being slid to a top of the tube holder 2.

In step 1616, the method 1600 includes the step of: traversely extends a second locking pin 12 against a stop piece 31 about the handle 3, and slidably couple the tube piece 1 in a tube holder cavity 21 having an upper portion formed along a midline of the tube holder 2, at least one portion of the locking sleeve 4 coupled in the tube holder cavity 21.

In step 1618, the method 1600 includes the steps of: slidably couple a baffle 13 on a portion of the tube piece 1 within the tube holder cavity 21 that is positioned below the locking sleeve 4, and lockably rotate the handle 3 to a locked state upon the handle 3 being slid to a top of the tube holder 2.

In step 1620, the method 1600 includes the step of: extends upwards the tube piece 1 between the baffle 13 located proximally between a first positioning hole 131, and a bottom of a tube holder cavity 21 is provided with a second positioning hole 211.

In step 1622, the method 1600 includes the step of: extends a stopper 42 beyond the top surface 412, and facilitate locking with a stopper 42 on the second side of the slidably coupled surface of the first locking pin 11 in the locking state.

In step 1624, the method 1600 includes the step of: traversely extends the first locking pin 11 through the tube piece 1 and through an additional boss 41 positioned about the boss 41 along the circumferential direction.

In step 1626, the method 1600 includes the step of: traversely extends the first locking pin 11 through a gap formed by the stopper 42 corresponding to the boss 41 and the additional boss 41; and traversely extends the second locking pin 12 through the tube piece 1 and through the stop piece 31 and an additional stop piece 31 positioned along the circumferential direction.

In step 1628, the method 1600 includes the step of: traversely extends a limiting groove formed among the two stop pieces 31; and position the second locking pin 12 in the limiting groove 32 after passing through an end of the tube piece 1.

It should be noted that step(s) 1612-1628 is/are optional steps and may not be implemented in all cases. Optional steps of method 1600 are illustrated using dotted lines in FIG. 16 so as to distinguish them from the other steps of method 1600.

Figure 17:
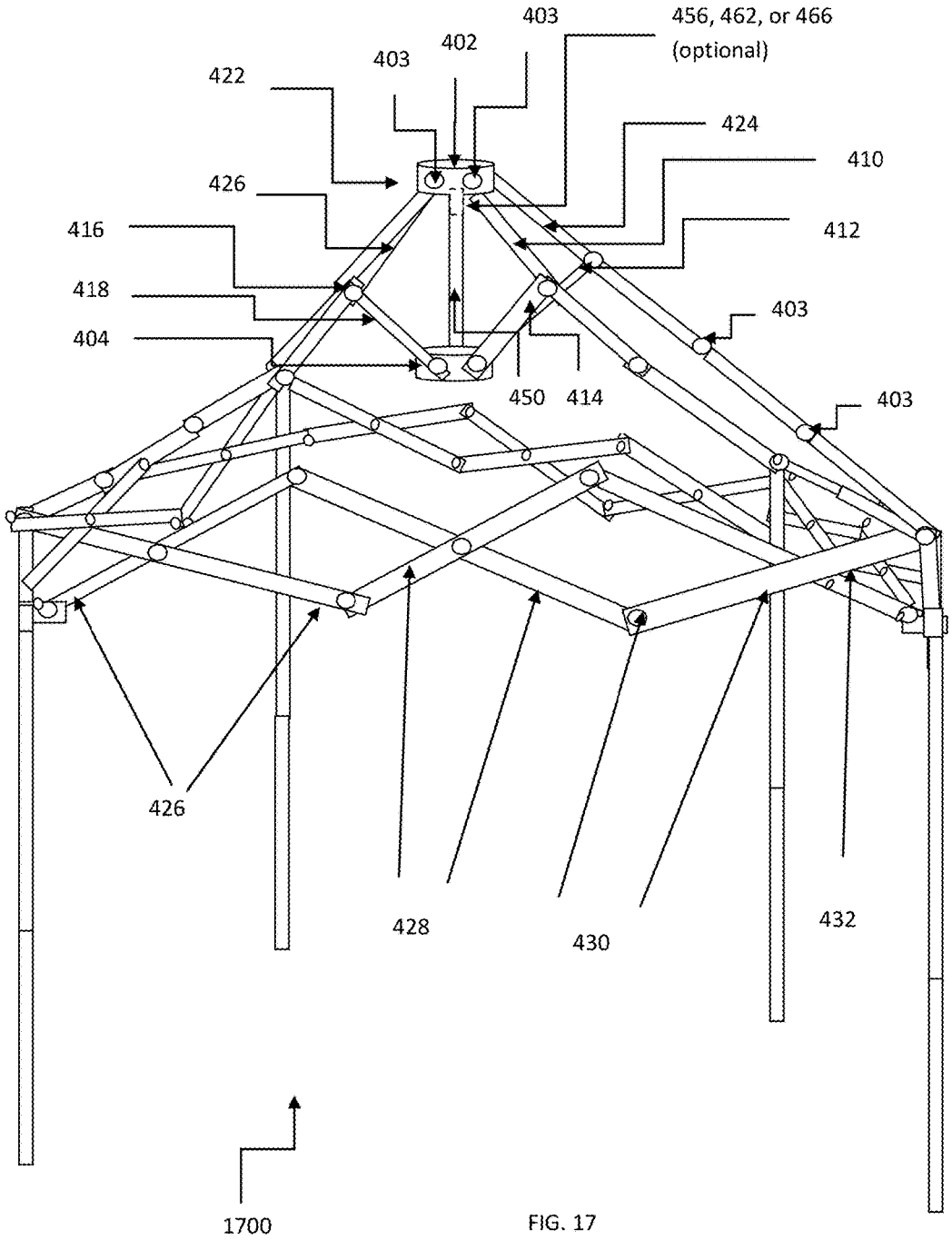
FIG. 17 is a front perspective view of a spring assist system for a canopy frame that is fully opened in accordance with an embodiment of the present disclosure.

Furthermore, FIGS. 17-26 are several embodiments that include examples of each of its features disclosed as an alternative embodiment of FIGS. 1 and 9 and illustrative of embodiment of FIG. 17 in accordance with an embodiment of the present disclosure.

Now referring to FIG. 17, a spring assist system is disclosed for a canopy. In this system, a frame includes: an extension spring 400 (see FIG. 18), an upper center cap 402 (see FIG. 18), and a lower center cap 404 (see FIG. 18). One end 408 of the extension spring 400 is coupled to the upper center cap 402 and the other end 406 is coupled to the lower center cap 404.

In some embodiments, extension spring 400 couples to the upper or the lower center caps 402, 404. For example, the coupling of the extension spring 400 can include bolting, clamping, screwing, eyelet, or clipping of the one end 406 and the other end 408 directly to or indirectly to, e.g., through a washer, metal or plastic clip, or epoxy to an upper center cap 402 and a lower center cap 404.

In one example, a force of the extension spring 400 draws, in an axial direction, the lower center cap 404 toward the upper center cap 402 to decrease a length of the extension spring 400.

In one or more exemplary embodiments of a canopy frame, extension spring 400 may be chosen within parameters including the following: a range of 24 inches to 48 inches body length, within a range of 1/16 of an inch to 1/8 of an inch wire diameter, within a range of 1/2 of an inch to 3/4 of an inch outer diameter, within a range of 1/4 to 1/2 inch mean diameter, and within a range of 26 inches to 50 inches length inside hooks.

In some of the embodiments, each of the upper center cap 402 and the lower center cap 404 include at least one connection point 403, e.g., pivots 403, used to attach at least one truss structure. For example, referring to FIG. 19, several truss structures 410, 412, 414, 416. 418, 420, 422, 424, 426 intersect and connect to, for example, at pivots 403. For example, pivots 403 can be rotatable rivets, pins, screws, bolts, nuts, sleeves, any short metal pin or bolts for holding the truss structures together, and the like. Furthermore, pivots 403 connect at their ends to upper center cap 402 and lower center cap 404 at connection points 403, e.g., screwed connection points 403.

Figure 18:
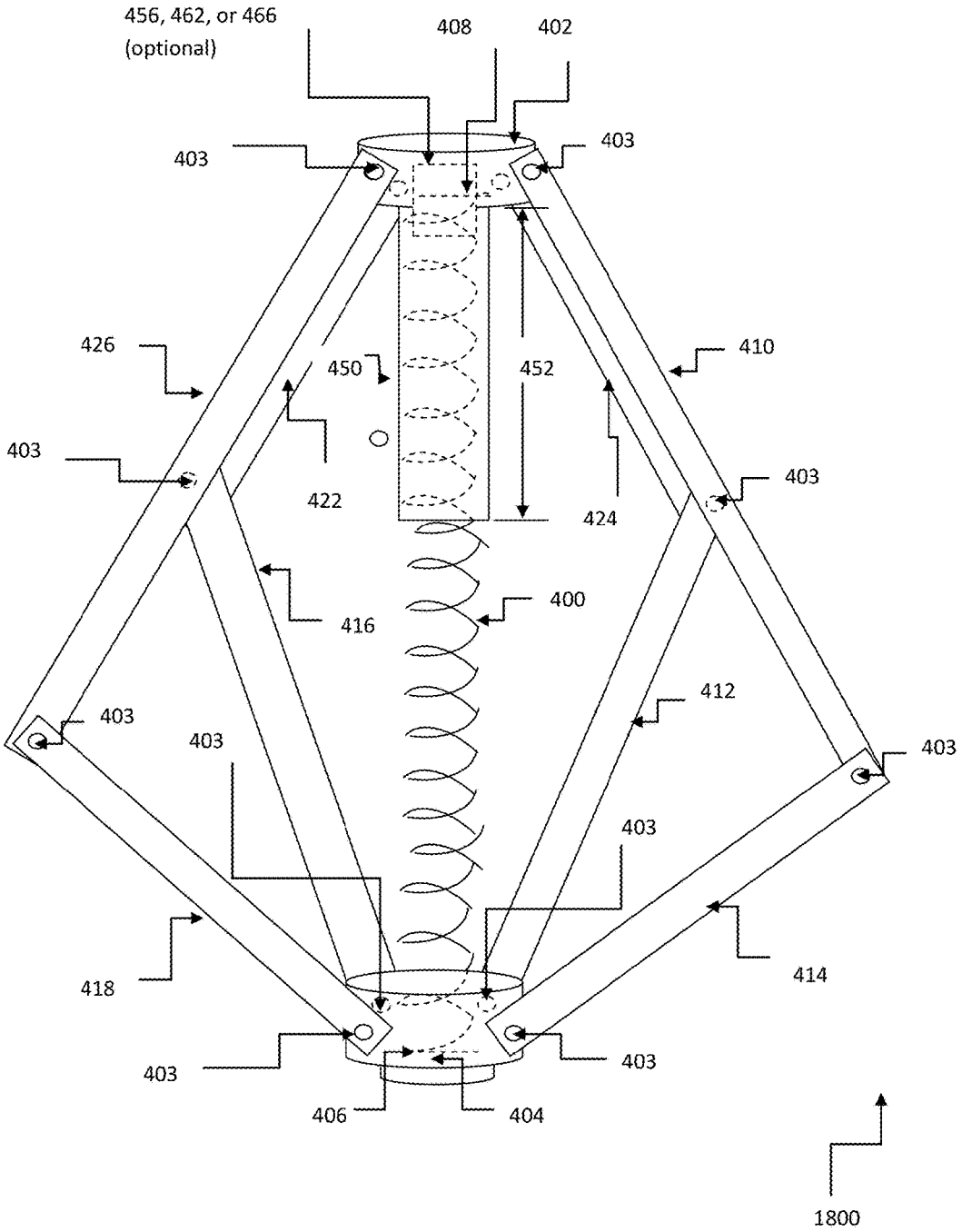
FIG. 18 is a close-up, partial front perspective view of a spring assist system for a canopy frame that is partially-opened of FIG. 17 in accordance with an embodiment of the present disclosure.
Figure 19:
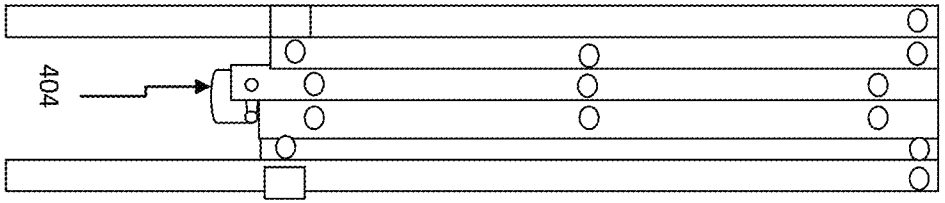
FIG. 19 is a front view of a spring assist system for a canopy frame that is collapsed of FIG. 17 in accordance with an embodiment of the present disclosure.
Figure 19:
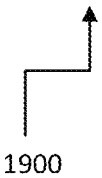

In some of the embodiments, now referring to FIGS. 17-26, i.e., most notably FIGS. 17 and 18, at least one of the connection points, e.g., connection points 403, is radially located on the upper center cap 402 and the lower center cap 404.

In some embodiments, now referring to FIGS. 17-26, i.e., most notably FIGS. 17 and 18, the at least one truss structure connected to the lower center cap 404 is pivotally connected, and applies a force onto, the at least one truss structure connected to the upper center cap 402.

In some embodiments, now referring to most notably in FIGS. 17 and 18, a spring sleeve 450 houses at least one or more portions of the extension spring 400. For example, a length 452 of the spring sleeve 450 limits a contraction of the extension spring 400 to a length equivalent to the length 452 of the spring sleeve 450.

In some embodiments, a spring sleeve 450 houses at least a portion of the extension spring 400. A length 452 of the spring sleeve 450 limits a contraction of the extension spring 400 to a length 452 less than full contraction of the extension spring 400.

In some of the embodiments, most notably in FIGS. 17 and 18, the one or more truss structure, e.g., truss structures 410, 412, 414, 416. 418, 420, 422, 424, 426, 428, 430, and 432 form a portion of a collapsible canopy framework 1700 with pivoting components 403, e.g., joint components, rivets, rotatable connection devices such as pin, sleeve, and locking end points, e.g., nuts, that limit a contraction of the extension spring 400 to a length 452 less than full contraction of the extension spring 400.

Figure 20:
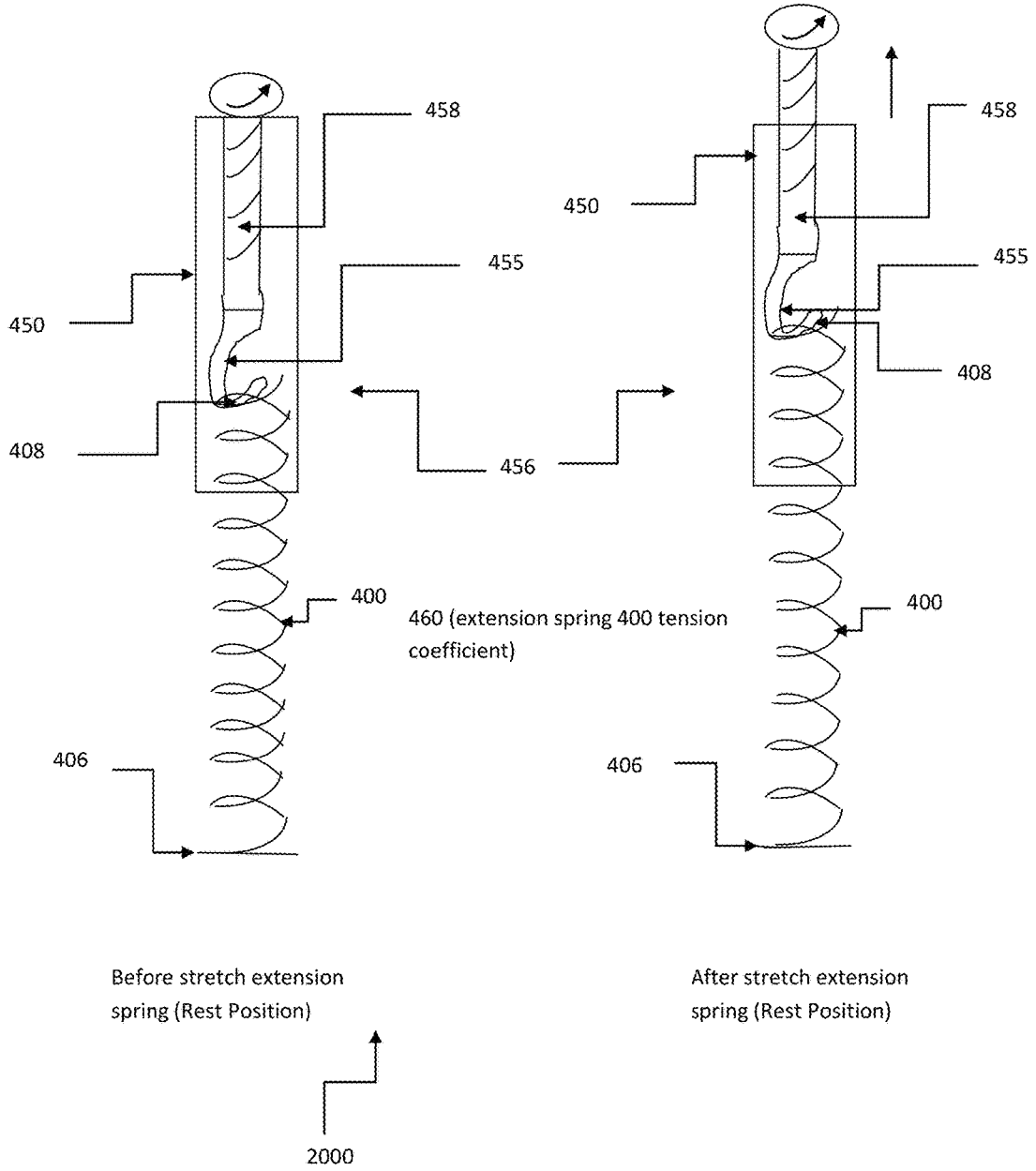
FIG. 20 is an illustration of an extension spring tension adjustment mechanism including an adjustable screw and hook before and after stretching extension spring 400 for a spring assist system for a canopy frame of FIG. 17 in accordance with an embodiment of the present disclosure.

In some of the embodiments, referring to FIG. 20, an extension spring tension adjustment mechanism 456 includes an adjustable screw 458 having a connectable end 455 attached to an end, e.g., either of extension spring ends 406, 408, of the extension spring 400. The adjustment screw 458 is capable of pulling the extension spring 400 so as to adjust a spring tension coefficient 460 of the extension spring 400, for instance, for a worn out (over stretched) extension spring. As such, this adjustment mechanism 456 can extend a life span and restore at least partially an original or required spring tension coefficient 600.

Figure 21:
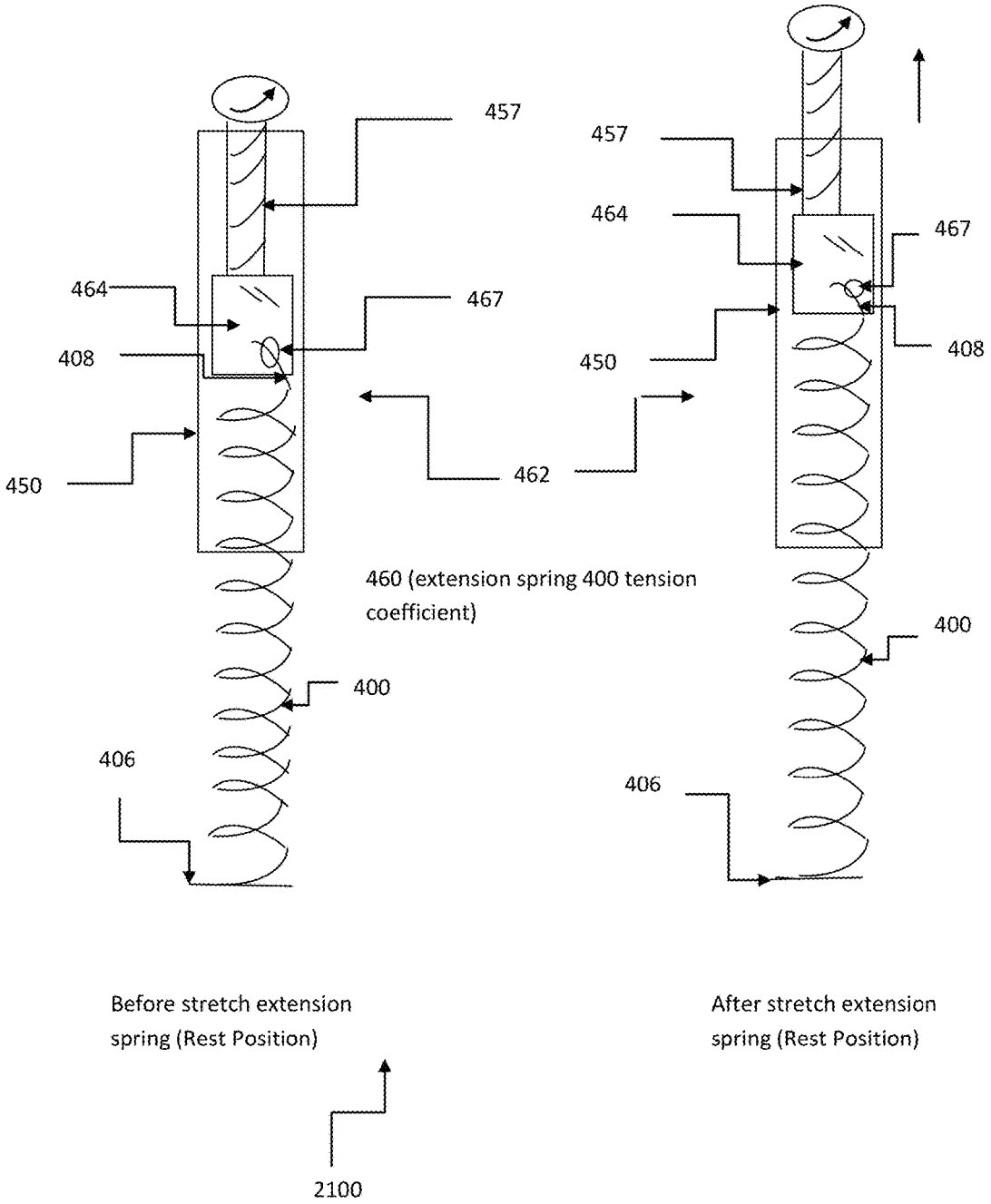
FIG. 21 is an illustration of an extension spring tension adjustment mechanism including an adjustable plate before and after stretching extension spring 400 for a spring assist system for a canopy frame of FIG. 17 in accordance with an embodiment of the present disclosure.

In some of the embodiments, referring to FIG. 21, an extension spring tension adjustment mechanism 462 including an adjustment screw 457, an adjustable plate 464 having an attachment end 467 (opening 467) attached to an end, e.g., one of the ends 406, 408, of the extension spring 400. The adjustable plate 464 is capable of movement back and forth to stretch the extension spring 400 to increase a spring tension coefficient 460 of the extension spring 400, for instance, when the extension spring 400 is worn out (over stretched). As such, this adjustment mechanism 462 can extend a life span and restore at least partially an original or required spring tension coefficient 400.

Figure 22:
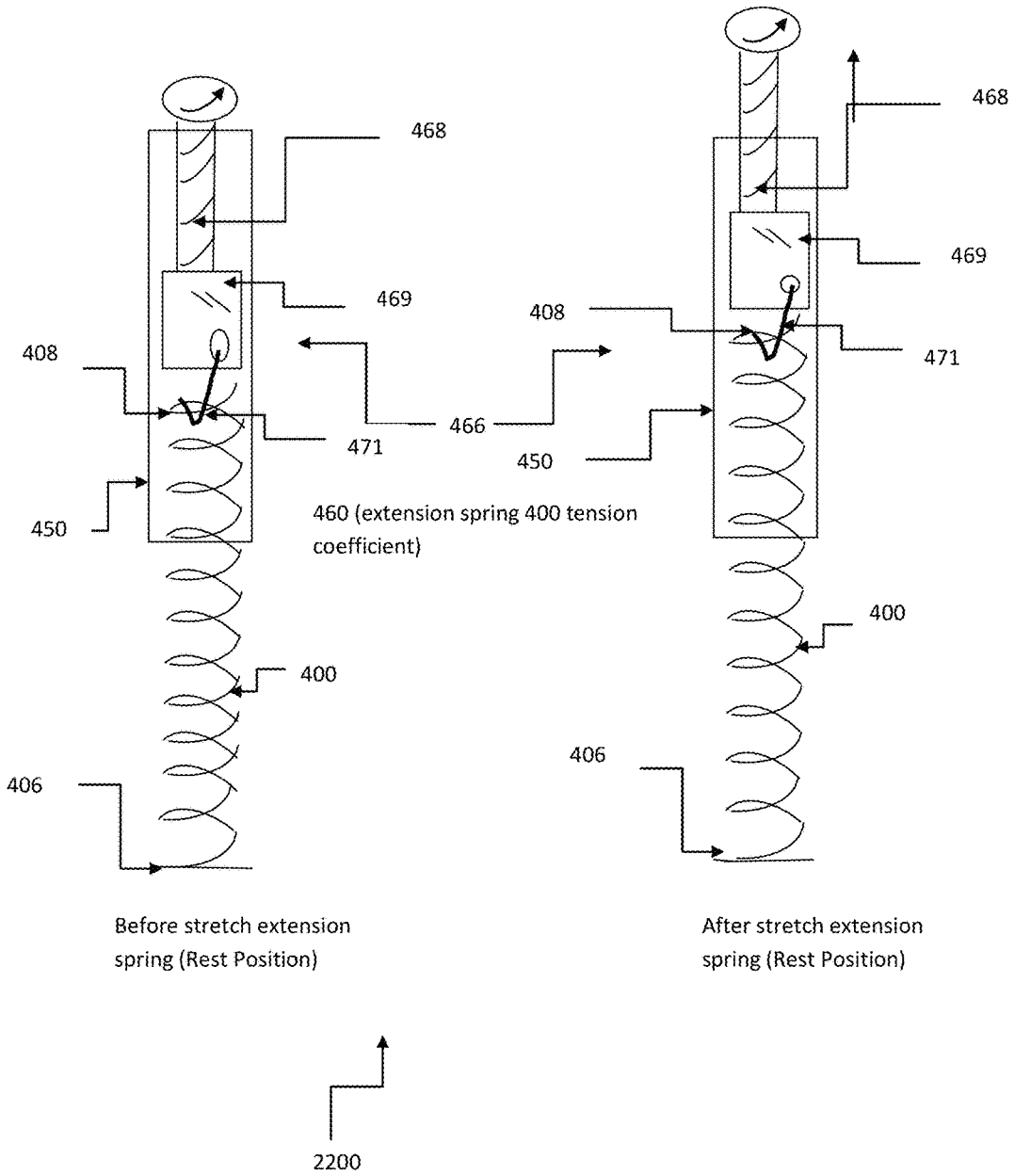
FIG. 22 is an illustration of an extension spring tension adjustment mechanism including an adjustable screw, plate, and hook before and after stretching extension spring 400 for a spring assist system for a canopy frame of FIG. 17 in accordance with an embodiment of the present disclosure.

In some of the embodiments, referring to FIG. 22, an extension spring tension adjustment mechanism 466 including an adjustable screw 468 at one end, e.g., extension spring ends 404, 408, of the extension spring 400, a sheet 469, and a hook 471 at the other end, e.g., at one of extension spring ends 404, 408, of the extension spring 400. The adjustment screw 468 is capable of pulling the extension spring 400 to adjust a spring tension coefficient 460 of the extension spring 400, for instance, when the extension spring 400 is worn out (over stretched). As such, this adjustment mechanism 466 can extend a life span and restore at least partially an original or required spring tension coefficient 400.

Figure 23:
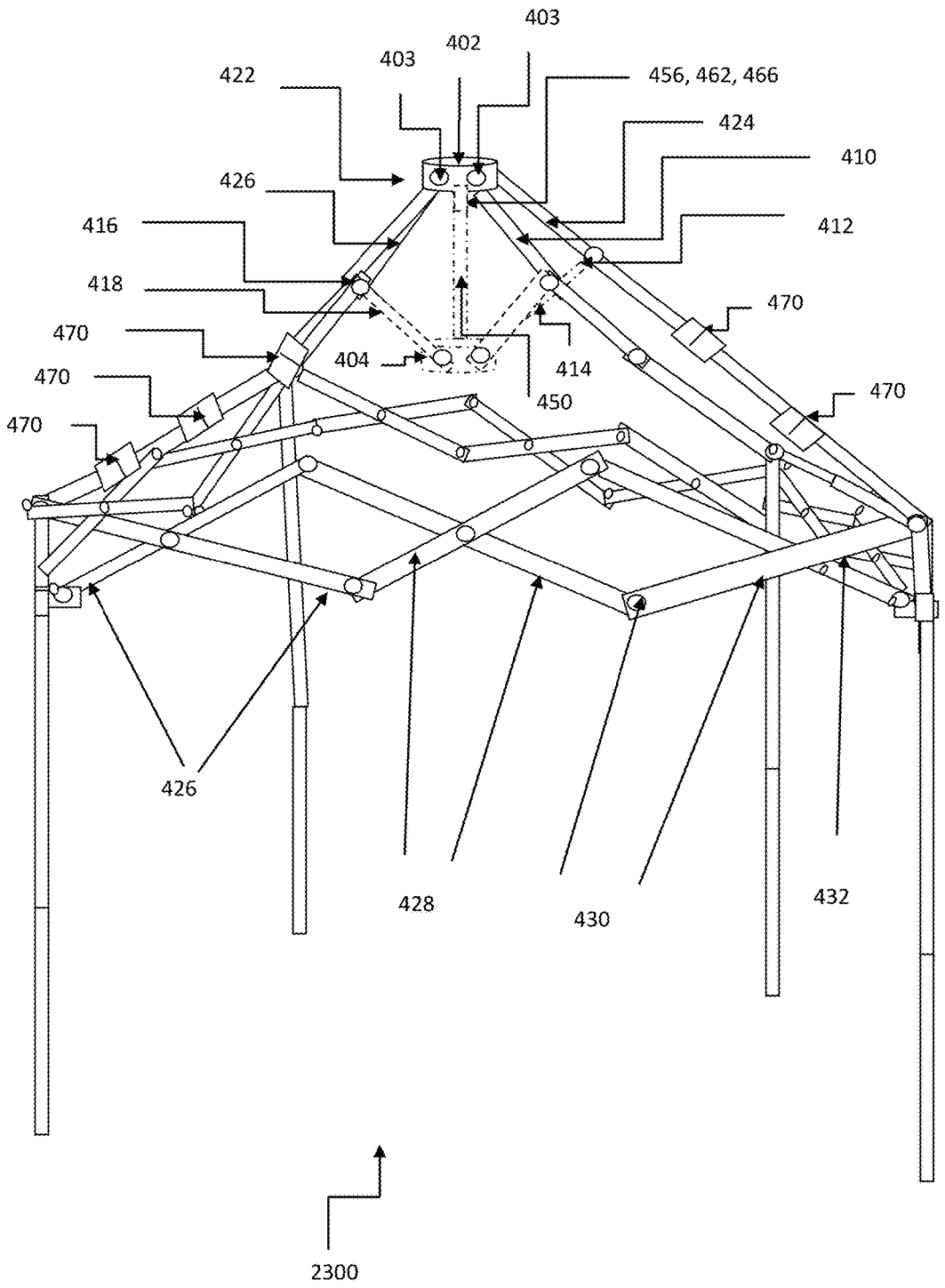
FIG. 23 is a front perspective view of a spring assist system that includes hinged springs at several joints of a canopy frame of FIG. 17 in accordance with another embodiment of the present disclosure.

In some embodiments, referring to FIG. 23, a spring assist system 2300 is disclosed for a canopy frame comprising: one or more hinge springs 470, and one or more truss structures having one or more hinge springs 470 attached to pivot points, e.g., replacing pivot points 403 at certain locations along, the one or more truss structures that form a collapsible canopy framework 2300.

Forces of the one or more hinge springs 470 in the pivot points and connections points of the collapsible canopy framework 2300 limit an unfolding of the collapsible canopy framework.

Please note that the items in dotted lines are optional items (e.g., spring adjustment mechanisms 456, 462, and 466) and may or may not include extension spring 400 (as illustrated in FIG. 18) and are not necessary for the functionality of this embodiment of this disclosure.

Most notably, in one or more embodiments, the system 2300 includes an extension spring 400 (see. FIG. 18) that is inside optional (dotted line) sleeve 450, an upper center cap 402, and a lower center cap 404. In one example, one end of the extension spring 400 (see FIG. 18) that is inside of optional (dotted line) sleeve 450 is coupled to the upper center cap and the other end is coupled to optional the lower center cap 404 (dotted line).

Continuing with this example, a force of the extension spring 400 (see FIG. 18) draws, in an axial direction, the lower center cap 404 toward the upper center cap 402 to decrease a length of the extension spring 400.

In one or more embodiments, each of the upper center cap 402 and the lower center cap 404 include at least one connection point 403 used to attach at least one truss structure.

In one or more embodiments, at least one of the connection points 403 is radially located on the upper center cap 402 and the lower center cap 404.

In one or more embodiments, the at least one truss structure connected to the lower center cap 404 is pivotally connected, and applies a force onto, the at least one truss structure connected to the upper center cap 402.

In one or more embodiments, the at least one truss structure forms the collapsible canopy framework with pivoting components 403 that limit a contraction of the extension spring 400 to a length less than full contraction of the extension spring 400.

In one or more embodiments, this aspect of the embodiment can include an extension spring tension adjustment mechanism 456 (see FIG. 20, same placement as illustrated in FIG. 17) including an adjustable screw 458 having a connectable end 455 attached to an end of the extension spring 400. The adjustment screw 458 capable of pulling the extension spring 400 so as to adjust a spring tension coefficient 460 of the extension spring 400.

In one or more embodiments, an extension spring tension adjustment mechanism 462 (see FIG. 21, same location as illustrated in FIG. 17) including an adjustable plate 467 having an attachment end 467 attached to an end of the extension spring 400. The adjustable plate 467 is capable of movement back and forth to stretch the extension spring 400 so as to increase a spring tension coefficient 600 of the extension spring 400.

In one or more embodiments, an extension spring tension adjustment mechanism 466 (see FIG. 22, same placement as illustrated in FIG. 17) including an adjustable screw 468 at one end of the extension spring 400 and a hook 471 at the other end of the extension spring 400. The adjustment screw 468 capable of pulling the extension spring 400 so as to adjust a spring tension coefficient 600 of the extension spring 400.

In one or more embodiments, a spring sleeve 450 (see FIG. 17 also) houses at least a portion of the extension spring 400. A length 452 of the spring sleeve 450 (see FIG. 17 also) limits a contraction of the extension spring 400 to a length equivalent to the length 452 of the spring sleeve 450 (see FIG. 17 also).

In one or more embodiments, a spring sleeve 450 houses at least a portion of the extension spring 400. A length of the spring sleeve 400 limits a contraction of the extension spring 400 to a length 452 less than full contraction of the extension spring 400.

Figure 24:
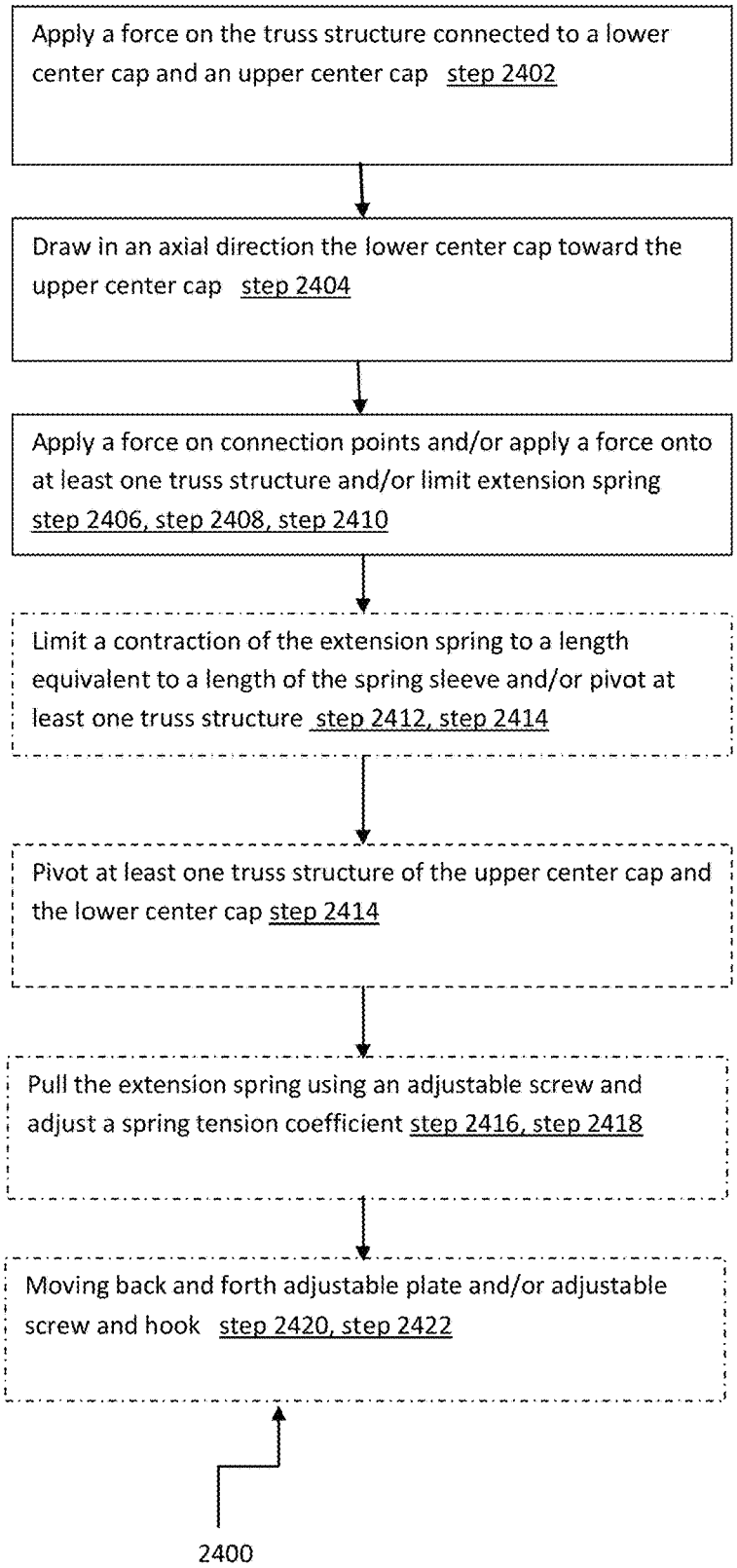
FIG. 24 is a method for operating a spring assist system for a canopy frame of FIG. 17 in accordance with an embodiment of the present disclosure.
Figure 25:
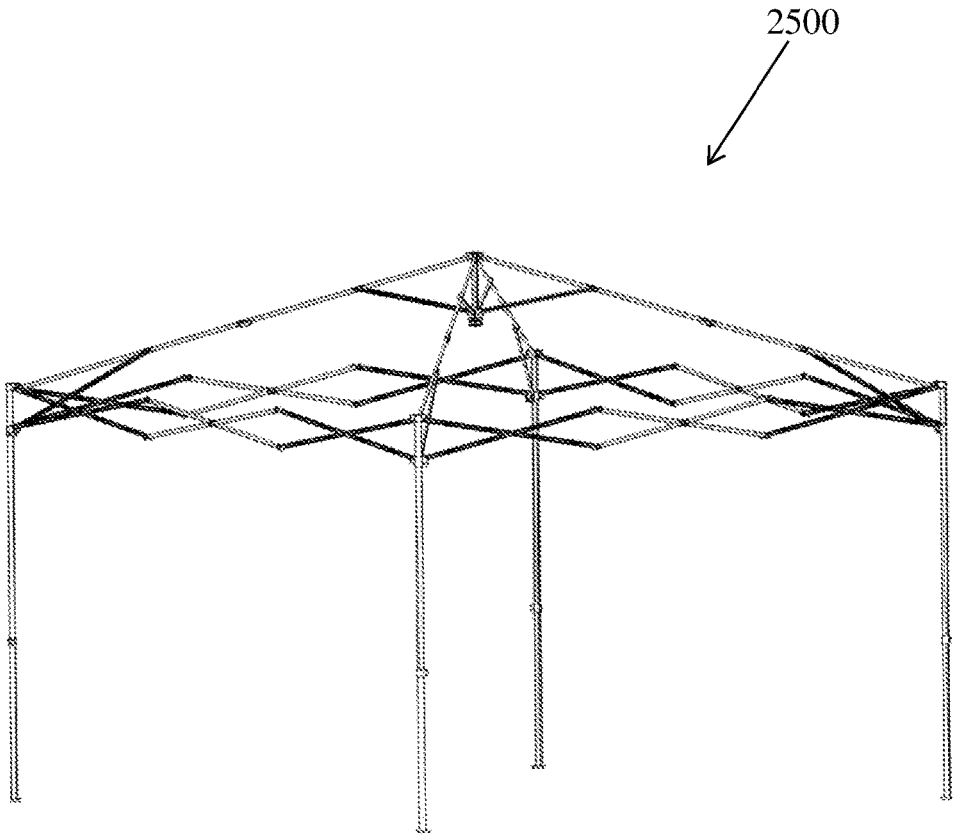
FIG. 25 is a picture of a fully-opened, front view of a spring assist system for a canopy frame of FIG. 17 in accordance with an embodiment of the present disclosure.
Figure 26:
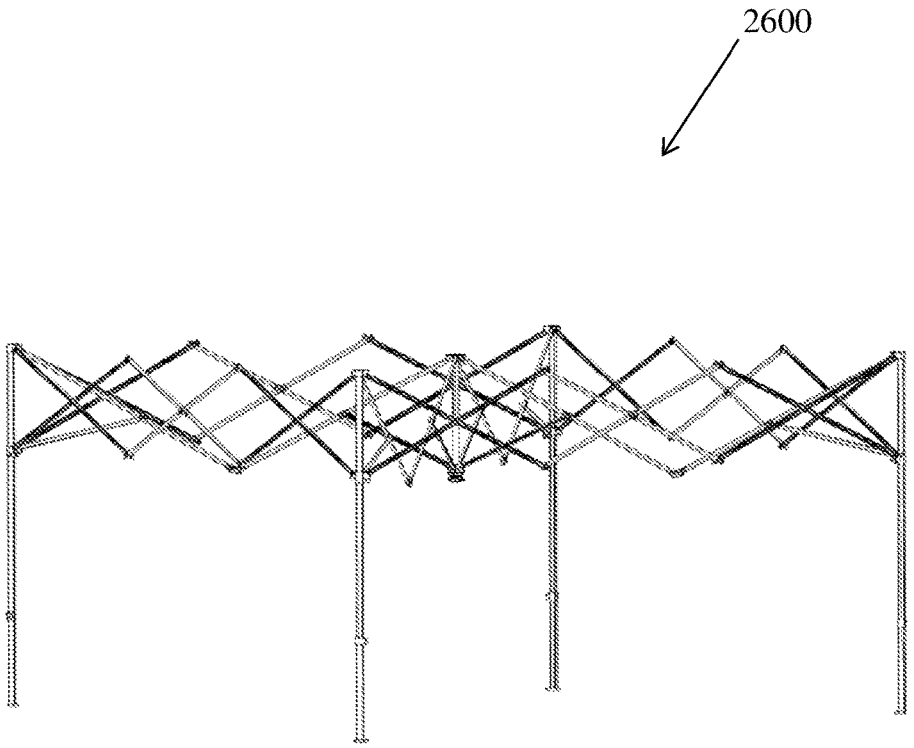
FIG. 26 is a picture of a partially opened, front perspective view of a spring assist system for a canopy frame of FIG. 17 in accordance with an embodiment of the present disclosure.

Now referring to FIG. 24, a method is disclosed for operating a spring assist system 2400 for a canopy frame.

The method 2400 includes the steps of:

in step 2402, apply a force onto at least one truss structure connected to at least one connection point of a lower center cap 404 to at least one truss structure connected at least one connection point of an upper center cap 402;

in step 2404, draw in an axial direction the lower center cap 404 toward the upper center cap 402, and decrease a length of an extension spring 400 coupled between the lower center cap 404 and the upper center cap 402 proportion to the force and a stop limit of axial directional motion of the lower center cap 404;

In step 2406, the method includes the step of apply a force on one or more connection points of the upper center cap 402 and the lower center cap 404 includes applying a force connection points radially located on the upper center cap 402 and the lower center cap 404;

In step 2408, the method includes the step of apply a force onto at least one truss structure connected to at least one connection point of a lower center cap 404 to at least one truss structure connected at least one connection point 403 of an upper center cap 402 includes applying a force onto the at least one truss structure connected to at least one connection point 403 of the lower center cap 404 is pivotally connected, and applies a force onto, the at least one truss structure connected to at least one connection point 403 of the upper center cap 402;

In step 2410, the method includes the step of limit a contraction of the extension spring 400 to a length equivalent to a length 452 of a spring sleeve 450 that houses at least a portion of the extension spring 400 during axial motion between the upper center cap 402 and the lower center cap 404;

In step 2412, the method includes the step of limit a contraction of the extension spring 400 to a length equivalent to length 452 of a spring sleeve 450 that houses at least a portion of the extension spring 400 during axial motion between the upper center cap 402 and the lower center cap 404. In one variation of this step, a length 452 of the spring sleeve 450 limits a contraction of the extension spring 400 to a length less than full contraction of the extension spring 400;

In step 2414, the method includes the step of pivot the at least one truss structure of the upper center cap 402 and the lower center cap 404 that forms a collapsible canopy framework 454 with pivoting components, e.g., rivets, that limit a contraction of the extension spring 400 to a length less than full contraction of the extension spring 400.

In step 2416, the method includes the step of pull the extension spring 400 using a adjustable screw 458 having a connectable end attached to an end of the extension spring 400 that forms an extension spring tension adjustment mechanism 456;

In step 2418, the method includes the step of adjustable spring tension coefficient 600 of the extension spring 400;

In step 2420, the method includes the steps of move back and forth an adjustable plate having an attachment end 466 attached to an end, e.g., ends 406, 408, of the extension spring 400 that forms an extension spring tension adjustment mechanism 462, stretching the extension spring 400, and increasing a spring tension coefficient 600 of the extension spring 400; and In step 2422, the method includes the steps of move back and forth an adjustable screw 468 at one end of the extension spring 400 and a hook 471 at the other end of the extension spring 400 that forms an extension spring tension adjustment mechanism 466, pulling the extension spring 400 with the adjustment screw 468; and adjust a spring tension coefficient of the extension spring 400.

It should be noted that step(s) 2412-2422 is/are optional steps and may not be implemented in all cases. Optional steps of method 2400 are illustrated using dotted lines in FIG. 24 so as to distinguish them from the other steps of method 2400.

It should be noted as herein described in the method, the steps and/or method of contemplated use can be carried out in many different ways, procedures, and the like according to, for example, one or more user preference(s). "[S]tep of" should not be interpreted as "step for", in the claims herein and is not intended to invoke the provisions of 35 U.S.C. § 112, ¶6.

Thus, specific embodiments and applications of system and apparatus for foldable tent and a clamping and supporting structure have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims.

Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the disclosure. In addition, where the specification and claims refer to at least one of something selected from the group consisting of A, B, C . . . and N, the text should be interpreted as requiring only one element from the group, not A plus N, or B plus N, etc.

What is claimed is:

1. A spring assist system for a canopy frame comprising:
an upper center cap;
a lower center cap; and
an extension spring tension adjustment mechanism coupled to the upper center cap and the lower center cap;
wherein the extension spring tension adjustment mechanism includes an extension spring, an adjustable screw, and an adjustable plate, wherein the extension spring is connected to the adjustable plate, and the adjustable plate is connected to the adjustable screw;
wherein a force of the extension spring draws, in an axial direction, drawing the lower center cap toward the upper center cap to decrease a length of the extension spring to open the canopy frame.

2. The system of claim 1, wherein each of the upper center cap and the lower center cap include at least one connection point used to attach at least one truss structure.

3. The system of claim 2, wherein at least one of the connection points is radially located on the upper center cap and the lower center cap.

4. The system of claim 2, wherein the at least one truss structure connected to the lower center cap is pivotally connected, and applies a force onto, the at least one truss structure connected to the upper center cap.

5. The system of claim 4, comprising a spring sleeve that houses at least a portion of the extension spring, wherein a length of the spring sleeve limits a contraction of the extension spring to a length equivalent to the length of the spring sleeve.

6. The system of claim 4, comprising a spring sleeve that houses at least a portion of the extension spring, wherein a length of the spring sleeve limits a contraction of the extension spring to a length less than full contraction of the extension spring.

7. The system of claim 4, wherein the at least one truss structure forms a collapsible canopy framework with pivoting components that limit a contraction of the extension spring to a length less than full contraction of the extension spring.

8. A method for operating a spring assist system for a canopy frame of claim 1 comprising:
applying a force onto at least one truss structure connected to at least one connection point of the lower center cap to at least one truss structure connected the at least one connection point of the upper center cap;
drawing in the axial direction the lower center cap toward the upper center cap; and
decreasing the length of the extension spring coupled between the lower center cap and the upper center cap proportion to the force and a stop limit of axial directional motion of the lower center cap.

9. The method of claim 8, wherein the step of:
applying a force on the at least one of the connection point of the upper center cap and the lower center cap includes applying a force connection points radially located on the upper center cap and the lower center cap.

10. The method of claim 8, comprising the step of:
limiting a contraction of the extension spring to a length equivalent to a length of a spring sleeve that houses at least a portion of the extension spring during axial motion between the upper center cap and the lower center cap.

11. The method of claim 10, comprising the steps of:

moving back and forth the adjustable plate having the attachment end attached to one end of the extension spring that forms the extension spring tension adjustment mechanism; and stretching the extension spring; and increasing the spring tension coefficient of the extension spring.

12. The method of claim 8, comprising the step of:

limiting a contraction of the extension spring to a length equivalent to length of a spring sleeve that houses at least a portion of the extension spring during axial motion between the upper center cap and the lower center cap, wherein a length of the spring sleeve limits a contraction of the extension spring to a length less than full contraction of the extension spring.

13. The method of claim 8, comprising pivoting the at least one truss structure of the upper center cap and the lower center cap that forms a collapsible canopy framework with pivoting components that limit a contraction of the extension spring to a length less than full contraction of the extension spring.

14. A spring assist system for a canopy frame comprising:

an upper center cap;

a lower center cap; and an extension spring tension adjustment mechanism coupled to the upper center cap and the lower center cap;

wherein the extension spring tension adjustment mechanism includes an extension spring and an adjustable screw; wherein the adjustable screw having a connectable end attached to one end of the extension spring; and wherein a force of the extension spring draws, in an axial direction, drawing the lower center cap toward the upper center cap to decrease a length of the extension spring to open the canopy frame.

15. The system of claim 14, wherein each of the upper center cap and the lower center cap include at least one connection point used to attach at least one truss structure.

16. The system of claim 15, wherein at least one of the connection points is radially located on the upper center cap and the lower center cap.

17. The system of claim 15, wherein the at least one truss structure connected to the lower center cap is pivotally connected, and applies a force onto, the at least one truss structure connected to the upper center cap.

18. The system of claim 17, comprising a spring sleeve that houses at least a portion of the extension spring, wherein a length of the spring sleeve limits a contraction of the extension spring to a length equivalent to the length of the spring sleeve.

19. The system of claim 17, comprising a spring sleeve that houses at least a portion of the extension spring, wherein a length of the spring sleeve limits a contraction of the extension spring to a length less than full contraction of the extension spring.

20. The system of claim 17, wherein the at least one truss structure forms a collapsible canopy framework with pivoting components that limit a contraction of the extension spring to a length less than full contraction of the extension spring.

21. A method for operating a spring assist system for a canopy frame of claim 14 comprising:

applying a force onto at least one truss structure connected to at least one connection point of the lower center cap to at least one truss structure connected at least one connection point of the upper center cap;

drawing in the axial direction the lower center cap toward the upper center cap; and decreasing the length of the extension spring coupled between the lower center cap and the upper center cap proportion to the force and a stop limit of axial directional motion of the lower center cap.

22. The method of claim 21, wherein the step of:

applying a force on the at least one of the connection point of the upper center cap and the lower center cap includes applying a force connection points radially located on the upper center cap and the lower center cap.

23. The method of claim 21, comprising the step of:

limiting a contraction of the extension spring to a length equivalent to a length of a spring sleeve that houses at least a portion of the extension spring during axial motion between the upper center cap and the lower center cap.

24. The method of claim 21, comprising the step of:

limiting a contraction of the extension spring to a length equivalent to length of a spring sleeve that houses at least a portion of the extension spring during axial motion between the upper center cap and the lower center cap, wherein a length of the spring sleeve limits a contraction of the extension spring to a length less than full contraction of the extension spring.

25. The method of claim 21, comprising pivoting the at least one truss structure of the upper center cap and the lower center cap that forms a collapsible canopy framework with pivoting components that limit a contraction of the extension spring to a length less than full contraction of the extension spring.

26. The method of claim 24, comprising the steps of:

moving back and forth the adjustable screw at one end of the extension spring and a hook at the other end of the extension spring that forms an extension spring tension adjustment mechanism;

pulling the extension spring with the adjustable screw; and adjusting the spring tension coefficient of the extension spring.

* * * * *